US008939096B2

(12) United States Patent
Yamanashi

(10) Patent No.: US 8,939,096 B2
(45) Date of Patent: Jan. 27, 2015

(54) APPARATUS, SEWING MACHINE, AND NON-TRANSITORY COMPUTER-READABLE MEDIUM

(71) Applicant: Yoko Yamanashi, Konan (JP)

(72) Inventor: Yoko Yamanashi, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 14/079,449

(22) Filed: Nov. 13, 2013

(65) Prior Publication Data

US 2014/0144359 A1 May 29, 2014

(30) Foreign Application Priority Data

Nov. 27, 2012 (JP) ..... 2012-258223

(51) Int. Cl.

| | |
|---|---|
| ***D05B 19/04*** | (2006.01) |
| ***D05B 21/00*** | (2006.01) |
| ***D05B 19/12*** | (2006.01) |
| ***D05C 5/06*** | (2006.01) |
| ***D05C 7/00*** | (2006.01) |
| *D05B 37/04* | (2006.01) |
| *D05C 5/02* | (2006.01) |

(52) U.S. Cl.

CPC *D05B 19/12* (2013.01); *D05C 5/06* (2013.01); *D05C 7/00* (2013.01)

USPC ..... 112/102.5; 112/129; 112/470.01

(58) Field of Classification Search

USPC ..... 112/102.5, 68, 89, 98, 129, 470.01, 112/470.04, 475.01, 475.19, 475.22; 700/136–138; 83/669, 684, 698.91

See application file for complete search history.

(56) References Cited

U.S. PATENT DOCUMENTS

| | | | | |
|---|---|---|---|---|
| 5,537,939 | A * | 7/1996 | Horton | 112/475.19 |
| 6,164,228 | A * | 12/2000 | Lin et al. | 112/475.22 |
| 6,860,214 | B1 * | 3/2005 | Wang | 112/475.22 |
| 7,966,956 | B2 * | 6/2011 | Suzuki et al. | 112/98 |
| 8,522,702 | B1 * | 9/2013 | Cho | 112/439 |
| 8,671,860 | B2 * | 3/2014 | Kawaguchi et al. | 112/475.05 |
| 2008/0229988 | A1 * | 9/2008 | Kishi | 112/102.5 |

FOREIGN PATENT DOCUMENTS

| | | |
|---|---|---|
| JP | A-8-158240 | 6/1996 |
| JP | A-10-60773 | 3/1998 |
| JP | A-2006-104583 | 4/2006 |
| JP | A-2007-111233 | 5/2007 |

* cited by examiner

*Primary Examiner* — Ismael Izaguirre
(74) *Attorney, Agent, or Firm* — Oliff PLC

(57) ABSTRACT

An apparatus includes a processor and a memory. The memory is configured to store computer-readable instructions that, when executed by the processor, instruct the processor to perform processes including acquiring pattern data, specifying an outline of the embroidery pattern based on the pattern data, creating hole data for causing the sewing machine to form a plurality of holes including one or more first holes and one or more second holes, creating first stitch data for causing the sewing machine to sew one or more stitches for the one or more first holes, and creating embroidery data for causing the sewing machine to form one or more first holes, and sew the one or more stitches for the one or more first holes, and causing the sewing machine to form the one or more second holes, before causing the sewing machine to sew an outline pattern.

20 Claims, 13 Drawing Sheets

FIG. 10

180

| CUTTING NEEDLE CUTTING EDGE DIRECTION (DEGREES) | 0 | 45 | 90 | 135 |
|---|---|---|---|---|
| LINE SEGMENT ANGLE (DEGREES) | NOT LESS THAN 0 AND LESS THAN 22.5, OR NOT LESS THAN 157.5 AND LESS THAN 180 | NOT LESS THAN 22.5 AND LESS THAN 67.5 | NOT LESS THAN 67.5 AND LESS THAN 112.5 | NOT LESS THAN 112.5 AND LESS THAN 157.5 |

FIG. 11

190

| | | | | | | | | | | | |
|---|---|---|---|---|---|---|---|---|---|---|---|
| LINE SEGMENT ANGLE (DEGREES) | 0 | 177 | ··· | 154 | 151 | ··· | 40 | 39 | ··· | 95 | 40 |
| PROXIMATE CUTTING NEEDLE CUTTING EDGE DIRECTION (DEGREES) | 0 | 0 | ··· | 135 | 135 | ··· | 45 | 45 | ··· | 90 | 45 |
| NEEDLE BAR NUMBER | 2 | 2 | ··· | 3 | 3 | ··· | 1 | 1 | ··· | 4 | 3 |

APPARATUS, SEWING MACHINE, AND NON-TRANSITORY COMPUTER-READABLE MEDIUM

CROSS-REFERENCE TO RELATED APPLICATION

This application claims priority to Japanese Patent Application No. 2012-258223 filed Nov. 27, 2012, the content of which is hereby incorporated herein by reference in its entirety.

BACKGROUND

The present disclosure relates to an apparatus that is configured to create embroidery data for an embroidery pattern to be sewn using an embroidery sewing machine, as well as to a sewing machine and a non-transitory computer-readable medium.

A device is known that is configured to create an object such as a patch or the like by cutting a work cloth along an outline of an embroidery pattern that has been sewn on the work cloth using an embroidery sewing machine. In a case where the object is formed using the device for the cutting out of decorative stitches, a user uses an embroidery sewing machine to form an embroidery pattern on a thermally fusible sheet that is held by an embroidery frame. Thereafter, the cutting-out device, while energizing the tip of a heat cutter such that the tip is in contact with a boundary between the thermally fusible sheet and the outline of the embroidery pattern, moves one of the thermally fusible sheet and the heat cutter in relation to one another along the outline of the embroidery pattern. In this manner, the cutting-out device thermally melts and cuts the thermally fusible sheet along the outline of the embroidery pattern.

SUMMARY

Because the cutting-out device described above uses the heat cutter to cut the work cloth along the outline of the embroidery pattern, the device itself is large.

Embodiments of the broad principles derived herein provide an apparatus that is provided with a function that creates embroidery data for forming an object such as a patch or the like that is cut out along an outline of an embroidery pattern without the use of a heat cutter, and also provide a sewing machine and a non-transitory computer-readable medium.

Embodiments provide an apparatus that includes a processor and a memory. The memory is configured to store computer-readable instructions that, when executed by the processor, instruct the processor to perform processes including acquiring pattern data representing a plurality of stitches for sewing, by a sewing machine, an embroidery pattern that includes an outline pattern, specifying an outline of the embroidery pattern based on the pattern data, creating, based on the specified outline, hole data for causing the sewing machine to form a plurality of holes along the specified outline, the hole data representing positions of needle drop points for forming the plurality of holes including one or more first holes and one or more second holes, creating, based on the hole data, first stitch data for causing the sewing machine to sew one or more stitches for the one or more first holes, the first data representing positions of needle drop points for sewing the one or more stitches that connect two regions separated by the plurality of holes, by spanning one of the plurality of holes, creating, based on the pattern data, the hole data, and the first stitch data, embroidery data for causing the sewing machine to form the one or more first holes, sew the one or more stitches for the one or more first holes, and causing the sewing machine to form the one or more second holes, before causing the sewing machine to sew the outline pattern.

Embodiments also provide a sewing machine that includes one or more needle bars, a sewing device, a processor, and a memory. Each of the one or more needle bars is configured to be mounted with one of a cutting needle and a sewing needle. The sewing device is configured to move one of the one or more needle bars up and down. The memory is configured to store computer-readable instructions that, when executed by the processor, instruct the processor to perform processes including acquiring pattern data representing a plurality of stitches for sewing, by a sewing device, an embroidery pattern that includes an outline pattern, specifying an outline of the embroidery pattern based on the pattern data, creating, based on the specified outline, hole data for causing the sewing device to form a plurality of holes along the specified outline, the hole data representing positions of needle drop points for forming the plurality of holes including one or more first holes and one or more second holes, creating, based on the hole data, first stitch data for causing the sewing device to sew one or more stitches for the one or more first holes, the first data representing positions of needle drop points for sewing the one or more stitches that connect two regions separated by the plurality of holes, by spanning one of the plurality of holes, creating, based on the pattern data, the hole data, and the first stitch data, embroidery data for causing the sewing device to form the one or more first holes, sew the one or more stitches for the one or more first holes, and causing the sewing device to form the one or more second holes, before causing the sewing device to sew the outline pattern, and causing, in accordance with the embroidery data, the sewing device to, form the plurality of holes by using the cutting needle, sew the connecting stitching, and sew the outline pattern.

Embodiments further provide a non-transitory computer-readable medium storing comprising computer-readable instructions. The computer-readable instructions, when executed, instruct a processor of an apparatus to perform processes including acquiring pattern data representing a plurality of stitches for sewing, by a sewing machine, an embroidery pattern that includes an outline pattern, specifying an outline of the embroidery pattern based on the pattern data, creating, based on the specified outline, hole data for causing the sewing machine to form a plurality of holes along the specified outline, the hole data representing positions of needle drop points for forming the plurality of holes including one or more first holes and one or more second holes, creating, based on the hole data, first stitch data for causing the sewing machine to sew one or more stitches for the one or more first holes, the first data representing positions of needle drop points for sewing the one or more stitches that connect two regions separated by the plurality of holes, by spanning one of the plurality of holes, creating, based on the pattern data, the hole data, and the first stitch data, embroidery data for causing the sewing machine to form the one or more first holes, sew the one or more stitches for the one or more first holes, and causing the sewing machine to form the one or more second holes, before causing the sewing machine to sew the outline pattern.

BRIEF DESCRIPTION OF THE DRAWINGS

Embodiments will be described below in detail with reference to the accompanying drawings in which:

FIG. 10 is a table that is used in processing that associates the needle drop point and a needle bar number with one another;

FIG. 11 is an explanatory figure of the processing that associates the needle drop point and the needle bar number with one another;

DETAILED DESCRIPTION

Hereinafter, an embodiment will be explained with reference to the drawings. A configuration of a multi-needle sewing machine (hereinafter simply referred to as a sewing machine) 1 according to the embodiment will be explained with reference to FIG. 1 to FIG. 3. The upper side, the lower side, the lower left side, the upper right side, the upper left side and the lower right side of FIG. 1 respectively correspond to the upper side, the lower side, the front side, the rear side, the left side and the right side of the sewing machine 1

Figure 1:
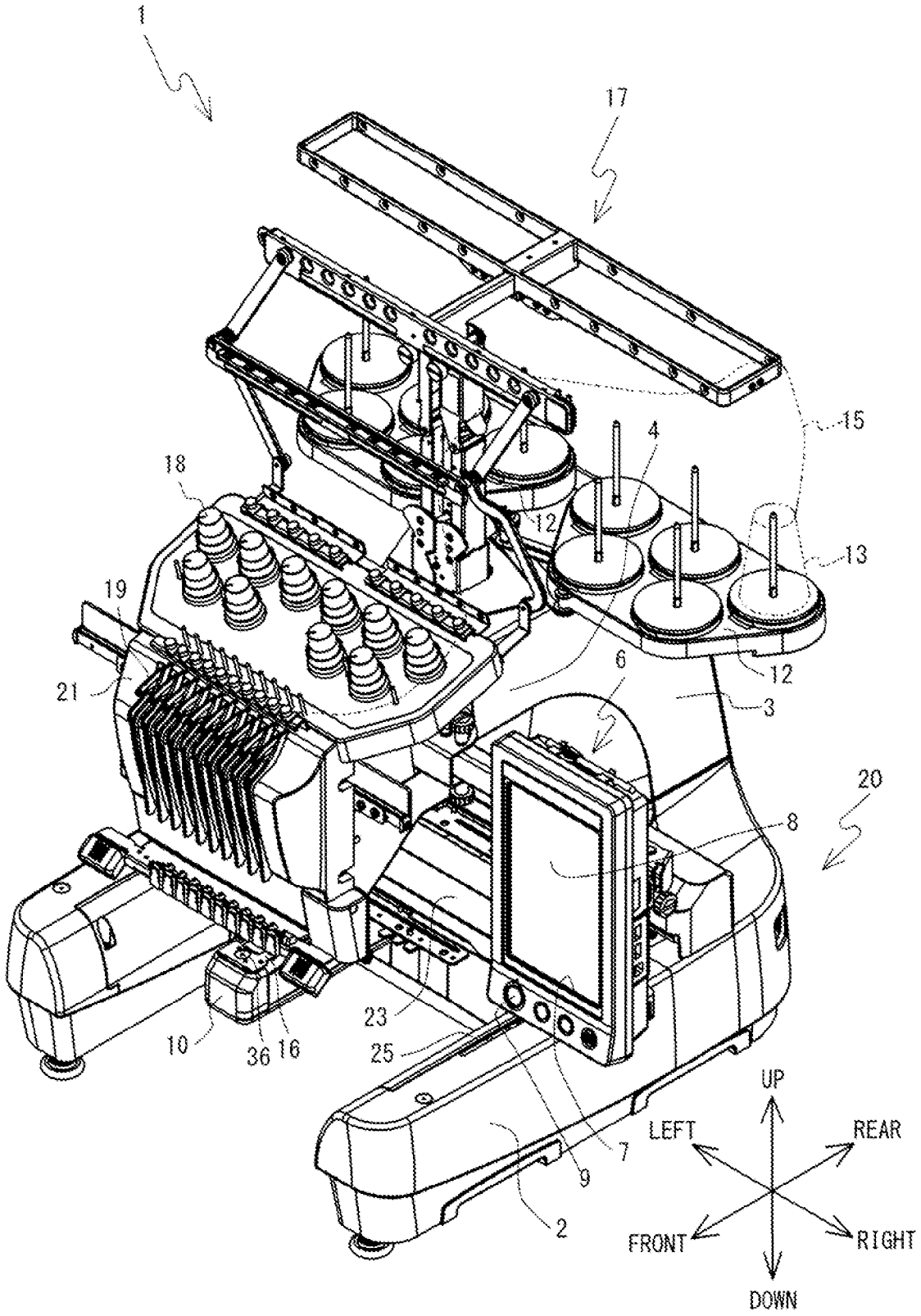
FIG. 1 is an oblique view of a sewing machine.

As shown in FIG. 1, a main body 20 of the sewing machine 1 includes a support portion 2, a pillar 3 and an arm portion 4. The support portion 2 is a base portion that is formed in an inverted U-shape in a plan view. A pair of left and right guide grooves 25, which extend in a front-rear direction, are provided in an upper surface of the support portion 2 (the left guide groove is not shown in FIG. 1). The pillar 3 extends upward from a rear end portion of the support portion 2. The arm portion 4 extends to the front from an upper end portion of the pillar 3. A needle bar case 21 is attached to the front end of the arm portion 4 such that the needle bar case 21 can move in a left-right direction. Ten needle bars 31 (refer to FIG. 2), which extend in an up-down direction, are disposed inside the needle bar case 21 at an equal interval in the left-right direction. One of the ten needle bars 31 that is in a sewing position may be caused to move up and down by a needle bar drive mechanism 32 (refer to FIG. 4) that is provided inside the needle bar case 21.

Figure 2:
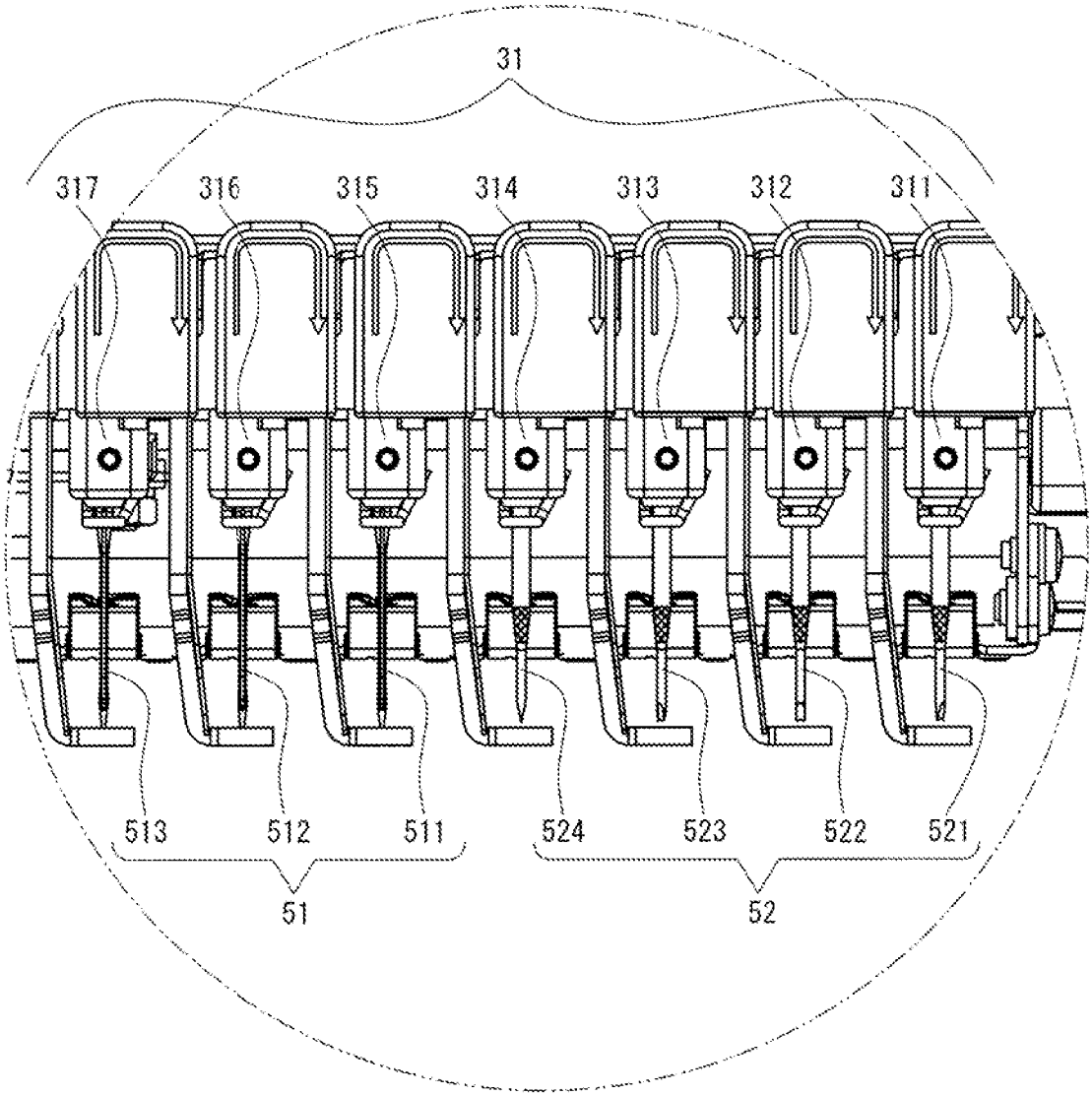
FIG. 2 is a partial front view of a lower end portion of a needle bar case.

A sewing needle 51 and a cutting needle 52 will be explained with reference to FIG. 2. Of the ten needle bars 31, only the seven needle bars 31 on the right side are shown in FIG. 2. One of the sewing needle 51 and the cutting needle 52 can be detachably attached to the lower end of each of the needle bars 31. FIG. 2 shows a state in which the sewing needles 51 (sewing needles 511, 512 and 513) are attached to fifth to seventh needle bars 315, 316 and 317 from the right. The sewing machine 1 may slidingly move the needle bar 31, on which the sewing needle 51 is mounted, in the up-down direction and thereby cause the sewing needle 51 to repeatedly reciprocate in the up-down direction. By doing this, the sewing machine 1 can perform sewing on a sewing workpiece 39 (refer to FIG. 3). The sewing workpiece 39 may be a work cloth, for example.

FIG. 2 shows a state in which the cutting needles 52 (cutting needles 521, 522, 523, 524) have been mounted on needle bars 311, 312, 313, 314 that are respectively the first to the fourth needle bars from the right. Each of the cutting needles 52 has a cutting edge to form a cut in the sewing workpiece 39 (refer to FIG. 3) on its lower end. A shaft portion provided in an upper portion of the cutting needle 52 has a partially cylindrical shape, a side surface of which is a flat surface. A positional relationship between a cutting edge direction and the flat surface formed in the shaft portion varies for each of the cutting needles 521 to 524. In a state in which the flat surface of the shaft portion of each of the cutting needles 52 faces the rear of the sewing machine 1, each of the cutting needles 52 can be attached to one of the needle bars 31. Therefore, the plurality of cutting needles 52 can be attached to the sewing machine 1 in a state in which directions of the cutting edges are different from each other. The direction of the cutting edge is the orientation of the cutting edge when the cutting needle 52 forms the cut in the sewing workpiece 39. In other words, the direction of the cutting edge indicates the orientation of the cut that is formed in the sewing workpiece 39, and it will be described in detail later.

An operation portion 6 shown in FIG. 1 is provided on the right side of a central portion in the front-rear direction of the arm portion 4. The operation portion 6 includes a liquid crystal display (hereinafter referred to as an LCD) 7, a touch panel 8 and a start/stop switch 9. For example, an image including various types of items, such as a command, an illustration, a setting value and a message etc., may be displayed on the LCD 7 based on image data. The touch panel 8 is provided on a front surface of the LCD 7. A user can perform a pressing operation on the touch panel 8, using a finger or a stylus pen. This operation is hereinafter referred to as a panel operation. The touch panel 8 may detect a position pressed by the finger or the stylus pen, and the sewing machine 1 (more specifically, a CPU 61 to be described later) may recognize the item that corresponds to the detected position. In this manner, the sewing machine 1 may recognize the selected item. The user can select an embroidery pattern, a command to be executed, or the like, by performing the panel operation. The start/stop switch 9 is a switch that is used to input, to the sewing machine 1, a command to start or stop sewing or forming of cuts.

A cylinder-shaped cylinder bed 10, which extends to the front from a lower end portion of the pillar 3, is provided below the arm portion 4 shown in FIG. 1. A shuttle (not shown in the drawings) is provided inside a front end portion of the cylinder bed 10. The shuttle can house a bobbin (not shown in the drawings) on which a bobbin thread (not shown in the drawings) is wound. A shuttle drive mechanism (not shown in the drawings) is provided inside the cylinder bed 10. The shuttle drive mechanism (not shown in the drawings) may rotatably drive the shuttle. A needle plate 16, having a rectangular shape in a plan view, is provided in the upper face of the cylinder bed 10. The needle plate 16 is provided with a needle hole 36 through which the sewing needle 51 can pass.

A pair of left and right thread spool bases 12 are provided on a rear portion of an upper surface of the arm portion 4 shown in FIG. 1. The number of thread spools 13 that can be mounted on the pair of the thread spool bases 12 is ten, which is the same as the number of the needle bars 31. A needle thread 15 may be supplied from one of the thread spools 13 mounted on the thread spool bases 12. The needle thread 15 may be supplied, via a thread guide 17, a tensioner 18, a thread take-up lever 19 and the like, to an eye (not shown in the drawings) of each of the sewing needles 51 (refer to FIG. 2) that may be attached to the lower end of each of the needle bars 31.

A Y carriage 23 (refer to FIGS. 1 and 3) of an embroidery frame movement mechanism 11 (refer to FIGS. 3 and 4) is provided below the arm portion 4. Various types of an embroidery frame 84 (refer to FIG. 3) can be attached to the embroidery frame movement mechanism 11. The embroidery frame 84 is configured to hold the sewing workpiece 39. The embroidery frame movement mechanism 11 may cause the embroidery frame 84 to move back and forth and left and right, using an X-axis motor 132 (refer to FIG. 4) and a Y-axis motor 134 (refer to FIG. 4) as driving sources.

The embroidery frame 84 and the embroidery frame movement mechanism 11 will be explained with reference to FIG. 3. The embroidery frame 84 includes an outer frame 81, an inner frame 82 and a pair of left and right coupling portions 89. The outer frame 81 and the inner frame 82 of the embroidery frame 84 may clamp the sewing workpiece 39. The coupling portions 89 are plate members having a rectangular shape in a plan view, and their central portions are cut out in a rectangular shape. One of the coupling portions 89 is fixed to a right portion of the inner frame 82 by screws 95. The other of the coupling portions 89 is fixed to a left portion of the inner frame 82 by screws 94.

The embroidery frame movement mechanism 11 includes a holder 24, an X carriage 22, an X-axis drive mechanism (not shown in the drawings), the Y carriage 23 and a Y-axis movement mechanism (not shown in the drawings). The holder 24 is configured to detachably support the embroidery frame 84. The holder 24 includes a mounting portion 91, a right arm portion 92 and a left arm portion 93. The mounting portion 91 is a plate member having a rectangular shape in a plan view, and it is longer in the left-right direction. The right arm portion 92 extends in the front-rear direction, and a rear end portion of the right arm portion 92 is fixed to the right end of the mounting portion 91. The left arm portion 93 extends in the front-rear direction. A rear end portion of the left arm portion 93 is fixed to a left portion of the mounting portion 91 such that the position in the left-right direction with respect to the mounting portion 91 can be adjusted. The right arm portion 92 may be engaged with the one of the coupling portions 89. The left arm portion 93 may be engaged with the other of the coupling portions 89.

The X carriage 22 is a plate member and is longer in the left-right direction. A pan of the X carriage 22 protrudes toward the front from the front face of the Y carriage 23. The mounting portion 91 of the holder 24 may be attached to the X carriage 22. The X-axis drive mechanism (not shown in the drawings) includes a linear movement mechanism (not shown in the drawings). The linear movement mechanism includes a timing pulley (not shown in the drawings) and a timing belt (not shown in the drawings). The linear movement mechanism may cause the X carriage 22 to move in the left-right direction (in the X direction), using the X-axis motor 132 as a driving source.

The Y carriage 23 is a box-shaped member that is longer in the left-right direction. The Y carriage 23 supports the X carriage 22 such that the X carriage 22 can move in the left-right direction. The Y-axis movement mechanism (not shown in the drawings) includes a pair of left and right movable members (not shown in the drawings) and a linear movement mechanism (not shown in the drawings). The movable members are connected to lower portions of the left and right ends of the Y carriage 23, and vertically pass through the guide grooves 25 (refer to FIG. 1). The linear movement mechanism includes a timing pulley (not shown in the drawings) and a timing belt (not shown in the drawings). The linear movement mechanism may cause the movable members to move in the front-rear direction (in the Y direction) along the guide grooves 25, using the Y-axis motor 134 as a driving source. The Y carriage 23 that is connected to the movable members, and the X carriage 22 that is supported by the Y carriage 23 may move in the front-rear direction (in the Y direction) in accordance with movement of the movable members. In a state in which the embroidery frame 84 that holds the sewing workpiece 39 is attached to the X carriage 22, the sewing workpiece 39 is disposed between the needle bars 31 (refer to FIG. 2) and the needle plate 16 (refer to FIG. 1).

Figure 4:
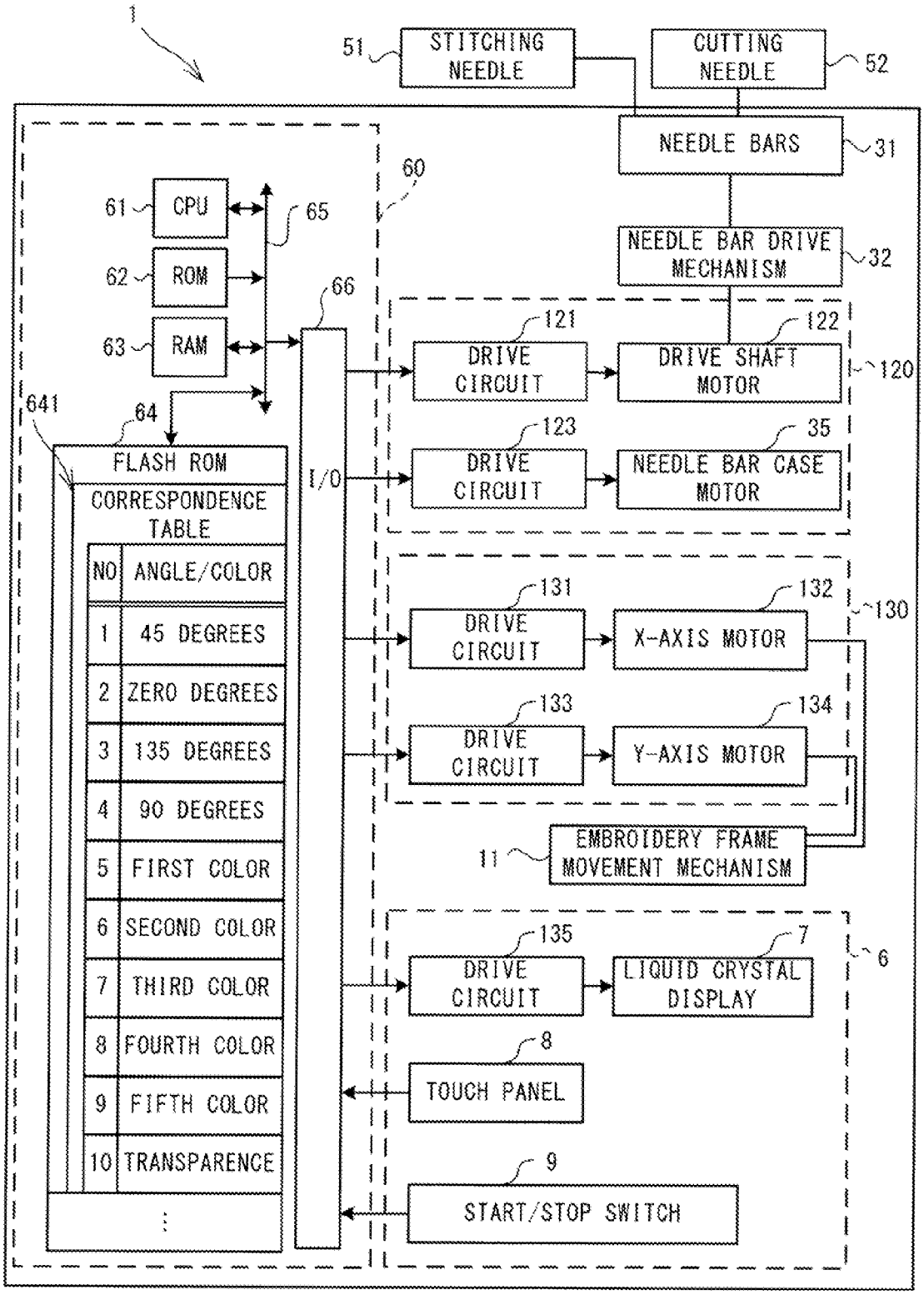
FIG. 4 is a block diagram that shows an electrical configuration of the sewing machine.

An electrical configuration of the sewing machine 1 will be explained with reference to FIG. 4. As shown in FIG. 4, the sewing machine 1 includes a sewing needle drive portion 120, a sewing target drive portion 130, the operation portion 6, and a control portion 60.

The sewing needle drive portion 120 includes a drive circuit 121, a drive shaft motor 122, a drive circuit 123 and a needle bar case motor 35. The drive circuit 121 may drive the drive shaft motor 122 in accordance with a control signal from the control portion 60. The drive shaft motor 122 may drive the needle bar drive mechanism 32 by rotatably driving a drive shaft (not shown in the drawings), and causes the needle bar 31 that is in the sewing position to reciprocate in the up-down direction. One of the sewing needle 51 and the cutting needle 52 can be detachably attached to each of the needle bars 31. The drive circuit 123 may drive the needle bar case motor 35 in accordance with a control signal from the control portion 60. The needle bar case motor 35 may drive a movement mechanism not shown in the drawings and thereby causes the needle bar case 21 (refer to FIG. 1) to move in the left-right direction.

The sewing target drive portion 130 includes a drive circuit 131, the X-axis motor 132, a drive circuit 133 and the Y-axis motor 134. The drive circuit 131 may drive the X-axis motor 132 in accordance with a control signal from the control portion 60. The X-axis motor 132 may drive the embroidery frame movement mechanism 11 and thereby cause the embroidery frame 84 (refer to FIG. 3) to move in the left-right direction. The drive circuit 133 may drive the Y-axis motor 134 in accordance with a control signal from the control portion 60. The Y-axis motor 134 may drive the embroidery frame movement mechanism 11 and thereby cause the embroidery frame 84 to move in the front-rear direction.

The operation portion 6 includes a drive circuit 135, the LCD 7, the touch panel 8 and the start/stop switch 9. The drive circuit 135 may drive the LCD 7 in accordance with a control signal from the control portion 60.

The control portion 60 includes the CPU 61, a ROM 62, a RAM 63, a flash ROM 64 and an input/output (I/O) interface 66, and they are mutually connected by a signal line 65. The sewing needle drive portion 120, the sewing target drive portion 130 and the operation portion 6 are respectively connected to the I/O interface 66.

The CPU 61 is configured to perform main control of the sewing machine 1. The CPU 61 may perform various operations and processing that relate to sewing, in accordance with various programs stored in a program storage area (not shown in the drawings) of the ROM 62. Although not shown in the drawings, the ROM 62 may include a plurality of storage areas including the program storage area. Various types of programs for operating the sewing machine 1 may be stored in the program storage area, including an embroidery data creation program and a sewing program. The embroidery data creation program is a program for performing embroidery data creation processing, which will be described later. The sewing program is a program for performing sewing processing, which will be described later. Storage areas that store data such as computation results and the like from computational processing by the CPU 61 may be provided in the RAM 63 as necessary. Various types of parameters for the performing of various types of processing by the sewing machine 1, including a correspondence table 641, may be stored in the flash ROM 64. The correspondence table 641 is a table in which each of a plurality of needle bar numbers (in the "NO" column in FIG. 4) is stored in association with one of the direction of the cutting edge of the cutting needle 52 that is mounted on the needle bar 31 that is indicated by the needle bar number and the color of the thread that is being supplied to the sewing needle 51 that is mounted on the indicated needle bar 31. The needle bar numbers are numbers that are assigned to each of the ten needle bars 31 to identify the needle bars 31, the needle bar numbers 1 to 10 being assigned in order starting from the right side. The direction of the cutting edge (hereinafter referred to as the cutting edge direction) of the cutting needle 52 will be explained later.

Figure 5:
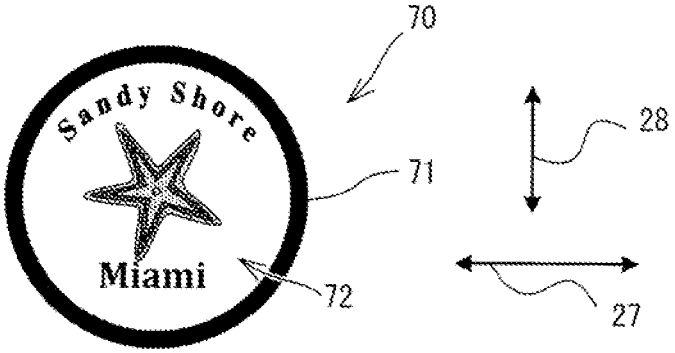
FIG. 5 is an explanatory figure of an embroidery pattern.

An embroidery pattern 70 and pattern data will be explained with reference to FIG. 5. Pattern data for sewing each of a plurality of embroidery patterns are stored in one of the ROM 62 and the flash ROM 64 that are shown in FIG. 4. The pattern data are data that represent a plurality of stitches that form an embroidery pattern that will be sewn by the sewing machine 1. The user can select a desired embroidery pattern, through the panel operation, from among the plurality of embroidery patterns that are represented by the pattern data. It is also possible for the user to cause the pattern data for forming an embroidery pattern to be created by using a pattern editing function of the sewing machine 1 to edit a desired embroidery pattern. The embroidery pattern 70, which will be used as an example, is an embroidery pattern that will be sewn with five colors of threads, from a first color to a fifth color. The embroidery pattern 70 is a pattern for forming a patch, and includes an outline pattern 71 and an interior pattern 72. In the present embodiment, the patch is an object that is cut out along the outline of the embroidery pattern 70, which is formed on the sewing workpiece 39. The outline pattern 71 is a pattern that forms the outline of the embroidery pattern 70. In the present embodiment, the outline pattern 71 is a pattern of satin stitches that form a circular border of a specified width. The interior pattern 72 is a pattern that is formed to the inside of the outline pattern 71. The interior pattern 72 is encircled by the outline pattern 71. In the present embodiment, the interior pattern 72 is a pattern that combines alphabetic characters and a figure of a starfish.

Figure 3:
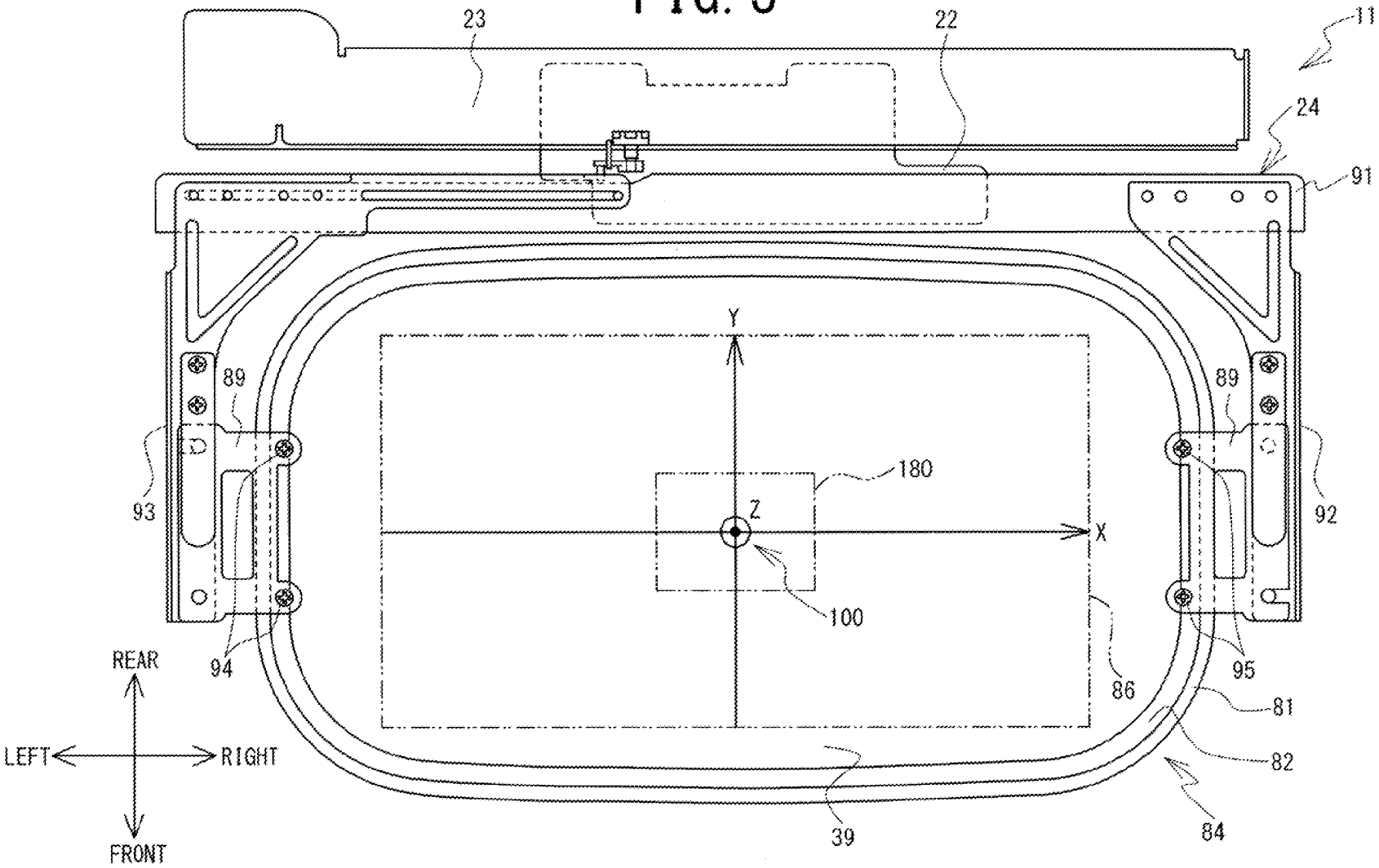
FIG. 3 is a plan view of an embroidery frame movement mechanism to which an embroidery frame is attached.

In the present embodiment, the pattern data include coordinate data in an embroidery coordinate system 100 that is shown in FIG. 3 and thread color data that represent the colors of the threads. The embroidery coordinate system 100 is the coordinate system for the X axis motor 132 and the Y axis motor 134 that move the X carriage 22. The coordinate data in the embroidery coordinate system 100 represent a position and an angle of the embroidery pattern in relation to a reference element (for example, the X carriage 22). The embroidery frame 84 that is configured to hold the sewing workpiece 39 may be mounted on the X carriage 22. Therefore, the coordinate data for the embroidery coordinate system 100 may represent the position and the angle of the embroidery pattern in relation to the sewing workpiece 39 that is held in the embroidery frame 84.

As shown in FIG. 3, in the embroidery coordinate system 100, the direction from left to right in the sewing machine 1 is the positive direction on the X axis, and the direction from front to rear in the sewing machine 1 is the positive direction on the Y axis. In the present embodiment, the initial position of the embroidery frame 84 is defined as the origin point (X, Y, Z)=(0, 0, 0) of the embroidery coordinate system 100. The initial position of the embroidery frame 84 is the position where the center point of a sewing area 86 that corresponds to the embroidery frame 84 is congruent with a needle drop point. The needle drop point is the point where the one of the sewing needle 51 and the cutting needle 52 (refer to FIG. 2) that is disposed directly above the needle hole 36 (refer to FIG. 1) pierces the sewing workpiece 39 when the needle bar 31 is moved downward from above the sewing workpiece 39. In the present embodiment, the embroidery frame movement mechanism 11 does not move the embroidery frame 84 in the Z axis direction (the up-down direction in the sewing machine 1). Therefore as long as the thickness of the sewing workpiece 39 is within a range in which it can be ignored, the Z axis coordinate of the top face of the sewing workpiece 39 may be defined as being zero.

The coordinate data in the pattern data that are stored in one of the ROM 62 and the flash ROM 64 define an initial layout of the embroidery pattern. In the present embodiment, the initial layout of the embroidery pattern is a layout in which the center point of the embroidery pattern is congruent with the origin point of the embroidery coordinate system 100 (the center point of the sewing area 86). In a case where the layout in relation to the sewing workpiece 39 is changed, the coordinate data in the pattern data are corrected accordingly. In FIG. 5, a left-right direction 27 and an up-down direction 28 respectively correspond to the X axis direction and the Y axis direction of the embroidery coordinate system 100.

An overview of the embroidery data creation processing and the sewing processing that are performed by the sewing machine 1 will be explained. In the embroidery data creation processing, embroidery data is created based on the pattern data for an embroidery pattern that the user has selected or edited. In the sewing processing, an object such as a patch or the like is formed in accordance with the embroidery data that were created in the embroidery data creation processing. The embroidery data are data for the performing of embroidery sewing by the sewing machine 1, which is provided with the needle bars 31. Each of the needle bars 31 is configured to be mounted with one of the sewing needle 51 and the cutting needle 52 having the cutting edge on its tip. In the present embodiment, the sewing machine 1, based on the pattern data, creates hole data, first stitch data, second stitch data, and cut data. The sewing machine 1 creates, as the embroidery data, data for sewing an embroidery pattern by sewing an outline pattern after forming of second partial holes. The hole data are data for causing the sewing machine 1 to form an outer side hole by having the sewing machine 1 use the cutting needle 52 to form a plurality of partial holes sequentially on the outer side of the embroidery pattern along the outline of the embroidery pattern. The outer side hole is a hole that separates an inner region that is surrounded by the outline of the embroidery pattern from an outer region that surrounds the inner region. The plurality of partial holes include one or more first partial holes and one or more second partial holes. The first partial holes, the second partial holes, and the outer side hole will be described later. The first stitch data are data for causing the sewing machine 1 to sew connecting stitching for the one or more first partial holes after forming of the one or more first partial holes and before forming of the one or more second partial holes. The connecting stitching includes one or more stitches that connect the inner region and the outer region by spanning one of the plurality of partial holes. The second stitch data are data for causing the sewing machine 1 to sew the connecting stitching for the one or more second partial holes after causing the sewing machine 1 to form the one or more second partial holes and before causing the sewing machine 1 to sew the outline pattern. The cut data are data for causing the sewing machine 1 to cut the one or more stitches of the connecting stitching by using the cutting needle 52. The hole data and the cut data each include coordinate data in the embroidery coordinate system 100 to indicate the coordinates of the respective needle drop points. The coordinate data in the hole data and the cut data represent the positions where the cutting needle 52 will pierce the sewing workpiece 39.

Figure 7:
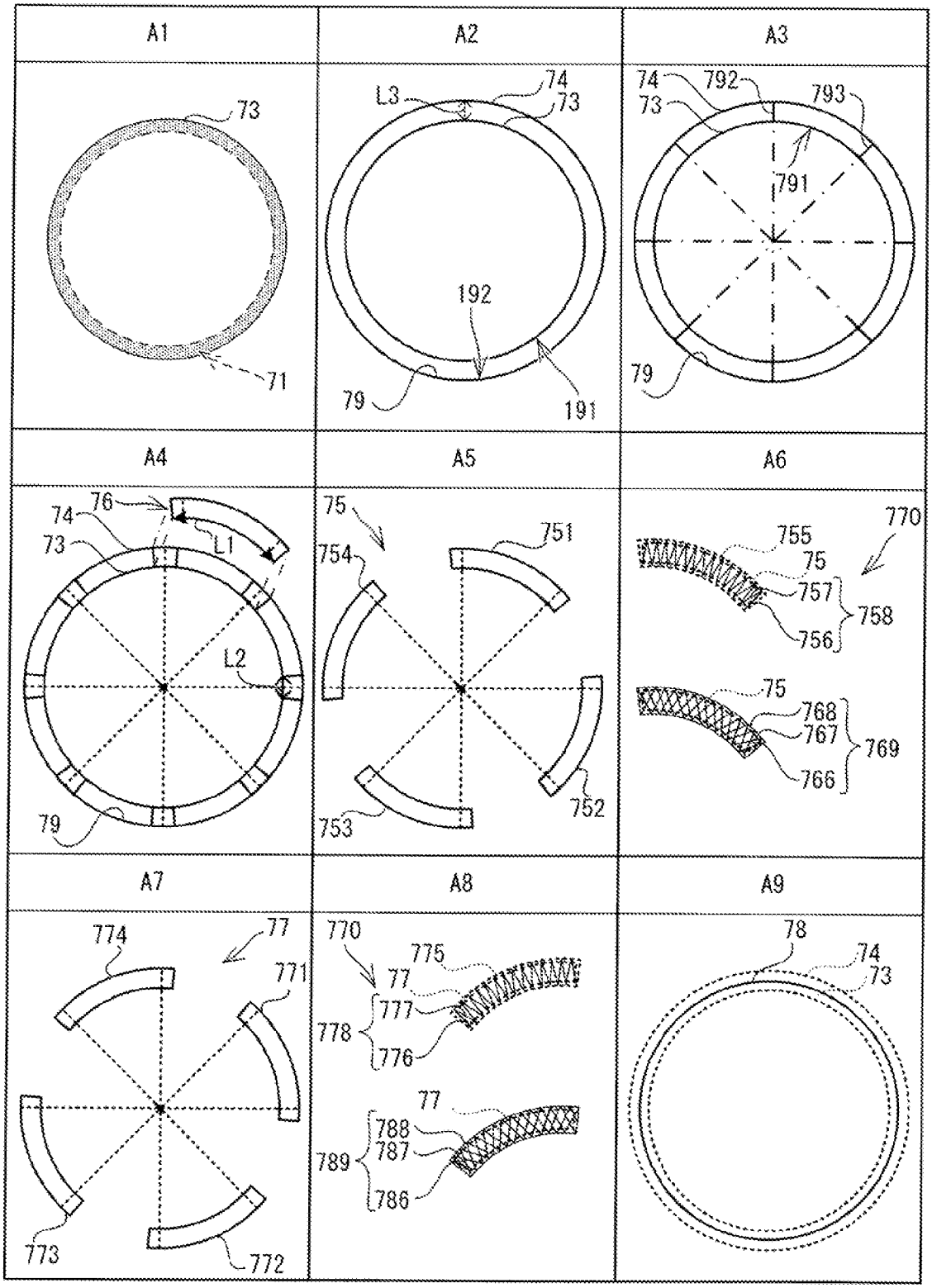
FIG. 7 is an explanatory figure of a process in which embroidery data are created in accordance with the embroidery data creation processing.
Figure 8:
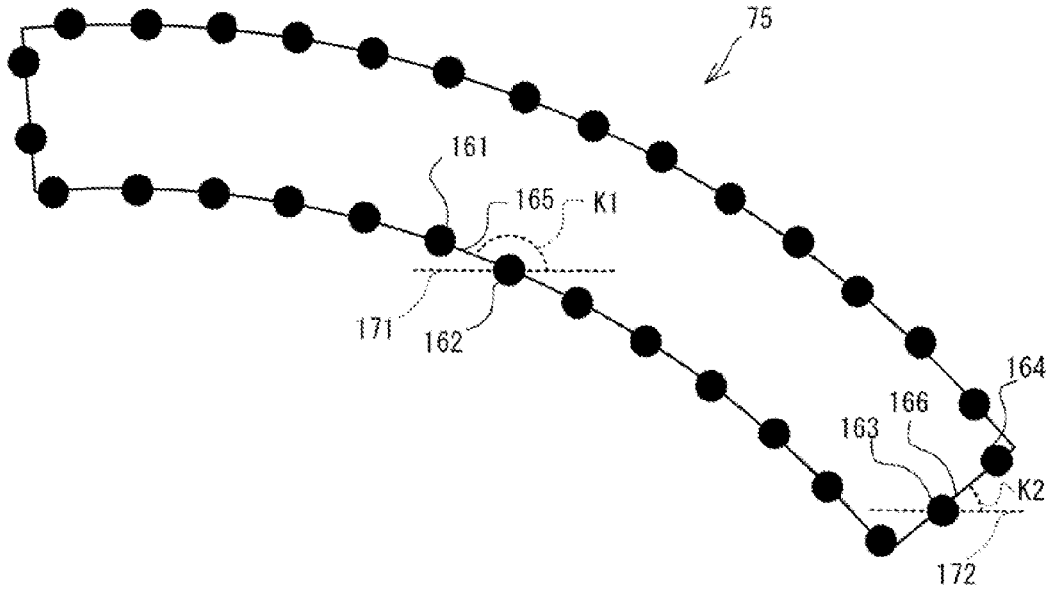
FIG. 8 is an explanatory figure of processing that sets needle drop points for forming a first partial hole by using a cutting needle.

The embroidery data creation processing will be explained with reference to FIGS. 6 to 8. The embroidery data creation processing is performed in a case where, after one of selecting and editing an embroidery pattern, the user inputs a start command through the panel operation. The program for performing the embroidery data creation processing may be stored in the ROM 62 (refer to FIG. 4) and is executed by the CPU 61. Data that are acquired and calculated in the process of the performing of the embroidery data creation processing may be appropriately stored in the RAM 63. As a specific example, a case will be explained in which, after editing the embroidery pattern 70, the user inputs the start command through the panel operation. The embroidery pattern 70, partial holes 76, a FIG. 78, and the like are shown schematically in FIG. 7, but the sizes of the individual elements in the drawing do not correspond to the actual sizes of the individual elements that are used as examples in the explanation that follows.

Figure 6:
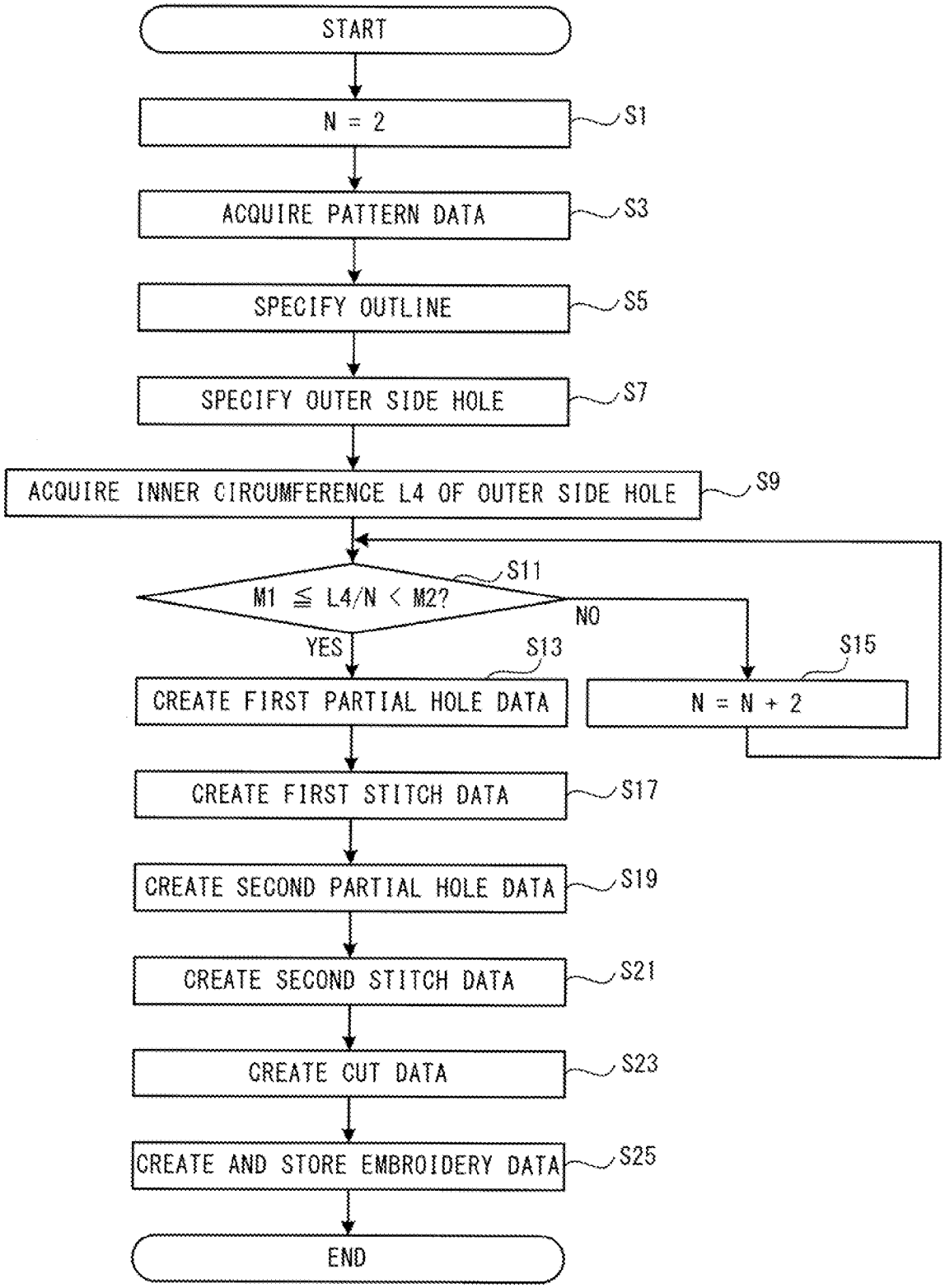
FIG. 6 is a flowchart of embroidery data creation processing.

As shown in FIG. 6, the CPU 61 sets to 2 a variable N that is used to set the number of the plurality of partial holes to an even number, then stores the variable N that has been set in the RAM 63 (Step S1). In the present embodiment, the sewing machine 1 forms the outer side hole by forming, as partial holes, the one or more first partial holes and the one or more second partial holes in that order. In the present embodiment, the CPU 61 sets the number of the partial holes to an even number in order to arrange the one or more first partial holes and the one or more second partial holes in alternation with one another. The partial holes will be described in detail later. The CPU 61 acquires the pattern data for the embroidery pattern 70 (Step S3). Based on the pattern data that were acquired by the processing at Step S3, the CPU 61 specifies the outline of the embroidery pattern 70 (Step S5). In the processing at Step S5, the CPU 61 may, for example, create an image that represents the embroidery pattern 70 in a finished form, based on the pattern data, and then identify the outline within the image. In a case where the outline pattern 71 can be identified, the CPU 61 may also identify the outline based on the coordinate data for the outline pattern 71. In the specific example, the CPU 61 specifies an outline 73 based on the coordinate data for the outline pattern 71, as shown in part A1 of FIG. 7.

The CPU 61 specifies the shape of the outer side hole (Step S7). As shown in part A2 of FIG. 7, an outer side hole 79 that is set in relation to the embroidery pattern 70 is formed along the outline 73 that was specified by the processing at Step S5, and the outer side hole 79 separates an inner region 191 from an outer region 192. The outline 73 is circular, and an inner circumference of the outer side hole 79 is indicated by the outline 73. An outer circumference 74 of the outer side hole 79 is a circle whose radius is larger than the radius of the outline 73 by a length L3. It is preferable for the length L3 to be a value that takes into account the size of the embroidery pattern, the thickness of the sewing workpiece, the material of the sewing workpiece, the thickness and the strength of the thread that is used for the connecting stitching, and the like. The length L3 may be five millimeters, for example.

The CPU 61 specifies a length L4 of the inner circumference of the outer side hole 79 (Step S9). The length L4 of the inner circumference of the outer side hole 79 is the length of the outline 73. In the specific example, the length L4 is eighteen centimeters. The CPU 61 determines whether a value that is calculated by dividing the length L4 that was acquired at Step S9 by the variable N is not less than a value M1 and less than a value M2 (Step S11). The processing at Step S11 is processing for adjusting a first length L1, to set the number of the partial holes to an even number, and to set the first length L1 to a value that is within a specified range. The first length L1 is the length of a portion, of each of the partial holes, that follows the outline 73. In the present embodiment, the first length L1 is a value that is calculated by adding a second length L2 to the value that was calculated by dividing the length L4 by the variable N. In the present embodiment, the CPU 61 creates the hole data such that the one or more first partial holes and the one or more second partial holes are arranged in alternation and partially overlap one another. The second length L2 is the length of a portion that follows along the outline 73 where one of the one or more first partial holes overlaps one of the one or more second partial holes. The values M1 and M2 are defined such that a value that is calculated by dividing the length L4 by an even number falls within the range of not less than the value M1 and less than the value M2. For example, the value M1 may be 2 centimeters, and the value M2 may be 2.5 centimeters.

In a case where the value that is calculated by dividing the length L4 by the variable N is one of less than the value M1 and not less than the value M2 (NO at Step S11), the CPU 61 updates the variable N by adding 2 to the current value of the variable N, then stores the updated variable N in the RAM 63 (Step S15). The CPU 61 returns the processing to Step S11. As shown in part A3 of FIG. 7, the result of dividing the length L4 by 8 is 2.25 centimeters, which is not less than the value M1 and is less than the value M2 (YES at Step S11). In this case, the CPU 61 creates first partial hole data (Step S13). The first partial hole data are a part of the hole data, and are data for causing the sewing machine 1 to form the one or more first partial holes by using the cutting needle 52.

In the processing at Step S13, the CPU 61 sets N partial holes. Specifically, as shown in part A3 in FIG. 7, the CPU 61 divides the outer side hole 79 into eight regions 791 of equal size, and then shift opposite ends 792, 793 of each of the regions 791 along the outline 73 outwards by one-half of the second length L2 respectively. As shown in part A4 of FIG. 7, eight of the fan-shaped partial holes 76 are thus created with the length of the inner side of each one being the first length L1. Each of the partial holes 76 overlaps each of the adjacent partial holes 76 by the second length L2. As shown in part A5 of FIG. 7, the CPU 61 specifies every other one of the eight partial holes 76, for a total of four of the partial holes 76, and defines them as first partial holes 751 to 754. Hereinafter, in cases where the first partial holes 751 to 754 are explained without differentiating among them, they will be called the first partial holes 75. The first partial holes 75 are not continuous with one another. The CPU 61 specifies the coordinates that represent the shape of each of the first partial holes 75 and creates, as the first partial hole data, data for cutting out the first partial holes 75 by using the cutting needle 52. For example, the CPU 61 may create the first partial hole data by setting needle drop points at equal intervals, as shown schematically in FIG. 8 by black dots along a line that indicates the shape of the first partial hole 75. The intervals between the needle drop points are shorter than the length of the cutting edge of the cutting needle 52.

The CPU 61 creates the first stitch data (Step S17). In the present embodiment, the connecting stitching that spans any one partial hole includes a plurality of stitches that extend in directions that intersect one another. This is done so that the inner region 191 will be pulled equally in a plurality of directions by the plurality of stitches that extend in directions that intersect one another and will be held in that state. The CPU 61 may create the first stitch data by the procedure hereinafter described, for example. As shown in part A6 of FIG. 7, the CPU 61 specifies a closed block 755 that is larger than the first partial hole 75 by a specified length toward the outer side of the first partial hole 75. Taking into account the fact that the sewing needle 51 will form stitches in the sewing workpiece 39, it is preferable for the specified length to be a value that is larger than 1 millimeter. In the present embodiment, the specified length is 2 millimeters. For example, the CPU 61 may define, as connecting stitching 758, zigzag stitches that have needle drop points on the sides that extend in the longitudinal direction of the closed block 755 and may create, as the first stitch data, data that represent the positions of the individual needle drop points. Among the stitches that are included in the connecting stitching 758, adjacent stitches extend in directions that intersect one another, as shown by stitches 756 and 757. The CPU 61 may also define, as connecting stitching 769, net-shaped stitches that have needle drop points on the sides that extend in the longitudinal direction of the closed block 755 and may create, as the first stitch data, data that represent the positions of the individual needle drop points. Stitches 766 and 767 that are included in the connecting stitching 769 extend in directions that intersect one another. Any one stitch that is included in the connecting stitching 769 intersects a plurality of stitches. The connecting stitching 769 includes stitches 768 that follow the outline of the closed block 755. In the present embodiment, the CPU 61 creates, as the first stitch data, data that represent the stitches of the connecting stitching 769.

The CPU 61 creates second partial hole data (Step S19). The second partial hole data are a part of the hole data, and are data for causing the sewing machine 1 to form the one or more second partial holes by using the cutting needle 52. From among the eight partial holes 76 that are shown in part A4 of FIG. 7, the CPU 61 selects the four partial holes 76 other than the first partial holes 75 that were defined by the processing at Step S13, and defines them as second partial holes 771 to 774, as shown in part A7 of FIG. 7. Hereinafter, in cases where the second partial holes 771 to 774 are explained without differentiating among them, they will be called the second partial holes 77. In cases where the first partial holes 75 and the second partial holes 77 are explained without differentiating between them, they will be called the partial holes 76. The CPU 61 specifies the coordinates that represent the shape of each of the second partial holes 77 and creates, as the second partial hole data, data for cutting out the second partial holes 77 by using the cutting needle 52. For example, in the same manner as in the case of the first partial holes 75, the CPU 61 may create the second partial hole data by setting needle drop points at equal intervals along a line that indicates the shape of the second partial hole 77.

The CPU 61 creates the second stitch data (Step S21). For example, the CPU 61 may create the second stitch data by the same sort of procedure that is used to create the first stitch data. As shown in part A8 of FIG. 7, the CPU 61 specifies a closed block 775 that is larger than the second partial hole 77 by a specified length toward the outer side of the second partial hole 77. In the present embodiment, the specified length is 2 millimeters. For example, the CPU 61 may define, as connecting stitching 778, zigzag stitches that have needle drop points on the sides that extend in the longitudinal direction of the closed block 775 and may create, as the second stitch data, data that represent the positions of the individual needle drop points. Among the stitches that are included in the connecting stitching 778, adjacent stitches extend in directions that intersect one another, as shown by stitches 776 and 777. The CPU 61 may also define, as connecting stitching 789, net-shaped stitches that have needle drop points on the sides that extend in the longitudinal direction of the closed block 775 and may create, as the second stitch data, data that represent the positions of the individual needle drop points. Stitches 786 and 787 that are included in the connecting stitching 789 extend in directions that intersect one another. Any one stitch that is included in the connecting stitching 789 intersects a plurality of stitches. The connecting stitching 789 includes stitches 788 that follow the outline of the closed block 775. In the present embodiment, the CPU 61 creates, as the second stitch data, data that represent the stitches of the connecting stitching 789. Hereinafter, in cases where the connecting stitching 769 that is formed for the first partial holes 75 and the connecting stitching 789 that is formed for the second partial holes 77 are explained without differentiating between them, they will be called the connecting stitching 770.

The CPU 61 creates the cut data (Step S23). In the present embodiment, at Step S23, the CPU 61 creates the cut data for cutting each of the stitches of the connecting stitching 769 that is formed in accordance with the first stitch data and the connecting stitching 789 that is formed in accordance with the second stitch data. In a case where the stitches of the connecting stitching 770 are cut in accordance with the cut data, the inner region 191 is separated from the outer region 192. The CPU 61 may create the cut data in accordance with the procedure hereinafter described, for example. As shown in part A9 of FIG. 7, the CPU 61 sets the FIG. 78 that encircles the outline 73 such that the FIG. 78 is on the outer side of the outline 73 and on the inner side of the outer circumference 74 of the outer side hole 79. The FIG. 78 is a circle whose is 2.5 millimeters greater than the radius of the outline 73, for example. The CPU 61 creates the cut data by setting needle drop points at equal intervals along a line that indicates the shape of the FIG. 78.

The CPU 61 creates the embroidery data based on the pattern data, the first partial hole data, the first stitch data, the second partial hole data, the second stitch data, and the cut data, which were one of acquired and created by the processing that precedes the processing at Step S25. The CPU 61 stores the created embroidery data in the RAM 63 (Step S25). In the present embodiment, at Step S25, the CPU 61 creates, as the embroidery data, data for sewing the embroidery pattern 70 by sewing the outline pattern 71 after forming the second partial holes 77. More specifically, the CPU 61 creates, as the embroidery data, data for forming the interior pattern 72, the first partial holes 75, the stitches of the connecting stitching 769 for the first partial holes 75, the second partial holes 77, the stitches of the connecting stitching 789 for the second partial holes 77, and the outline pattern 71, in that order, and then cutting the stitches of the connecting stitching 770 last. The CPU 61 then terminates the embroidery data creation processing.

The sewing processing will be explained with reference to FIGS. 8 to 12. The sewing processing is performed in a case where, after the embroidery data have been created in accordance with the embroidery data creation processing that is shown in FIG. 6, the user inputs a start command through one of the panel operation and the start/stop switch 9. The program for performing the sewing processing may be stored in the ROM 62 (refer to FIG. 4) and is executed by the CPU 61. Data that are acquired and calculated in the process of the performing of the sewing processing may be appropriately stored in the RAM 63. As a specific example, a case will be explained in which, after performing the embroidery data creation processing for the embroidery pattern 70, the user inputs the command to start sewing through the panel operation. When the sewing is started, the sewing needles 51 are mounted on the needle bars 31 with the needle bar numbers 5 to 9, and the threads of the first color to the fifth color that are required for sewing the embroidery pattern 70 are supplied to the respective sewing needles 51, as shown in the correspondence table 641 in FIG. 4. One of the sewing needles 51 is mounted on the needle bar 31 with the needle bar number 10, and a transparent thread is supplied to that sewing needle 51. Four of the cutting needles 52, each with a cutting edge whose direction is different from the cutting edges of the other cutting needles 52, are attached to the needle bars 31 with the needle bar numbers 1 to 4. When the sewing is started, the sewing workpiece 39 is being held by the embroidery frame 84. The embroidery pattern 70, the partial holes 76, the connecting stitching 769, 789, and the like that are formed in the sewing workpiece 39 that is held by the embroidery frame 84 are shown schematically in FIG. 12, but the sizes of the individual elements in the drawing do not correspond to the actual sizes of the individual elements that have been described above.

Figure 9:
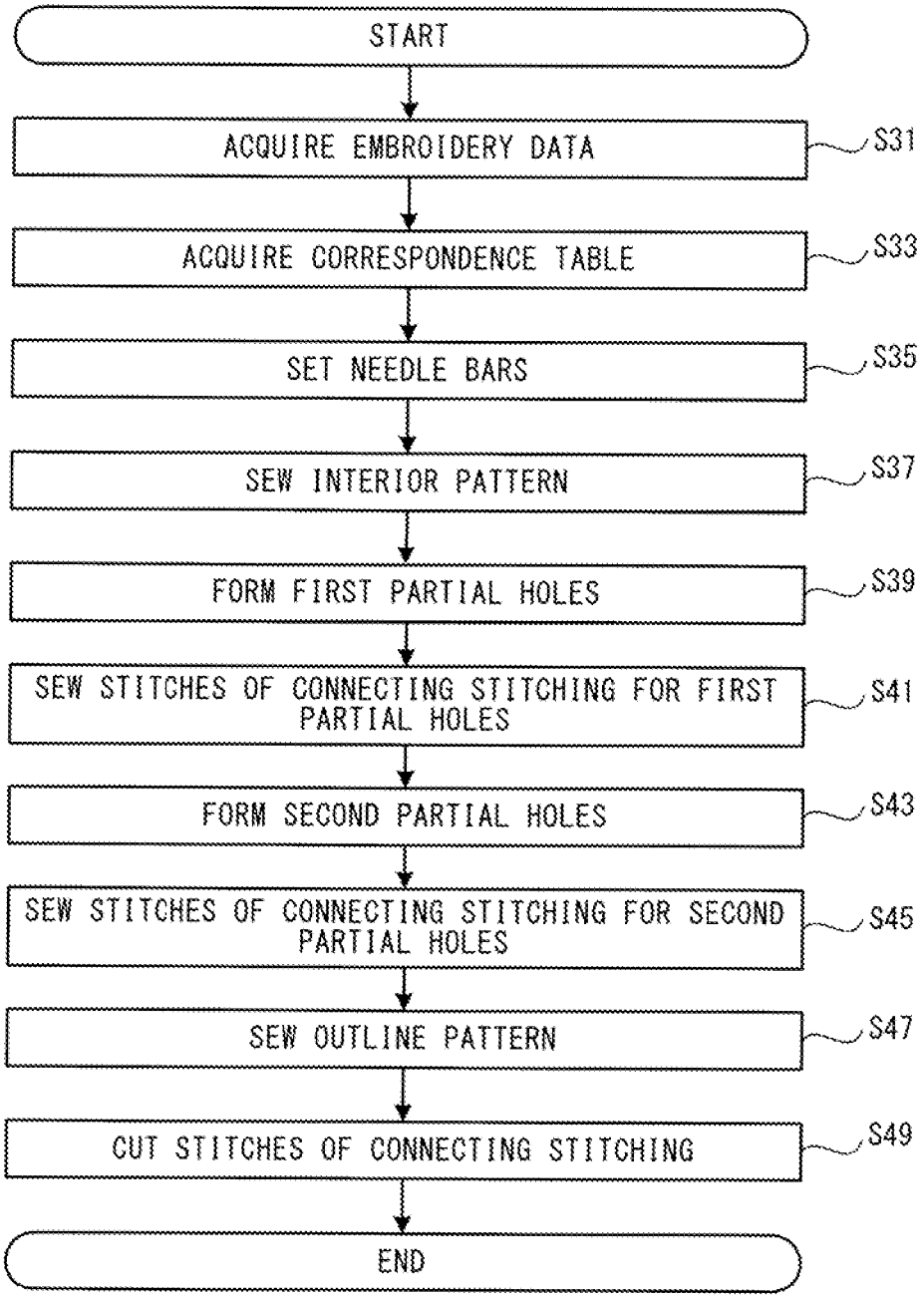
FIG. 9 is a flowchart of sewing processing.
Figure 12:
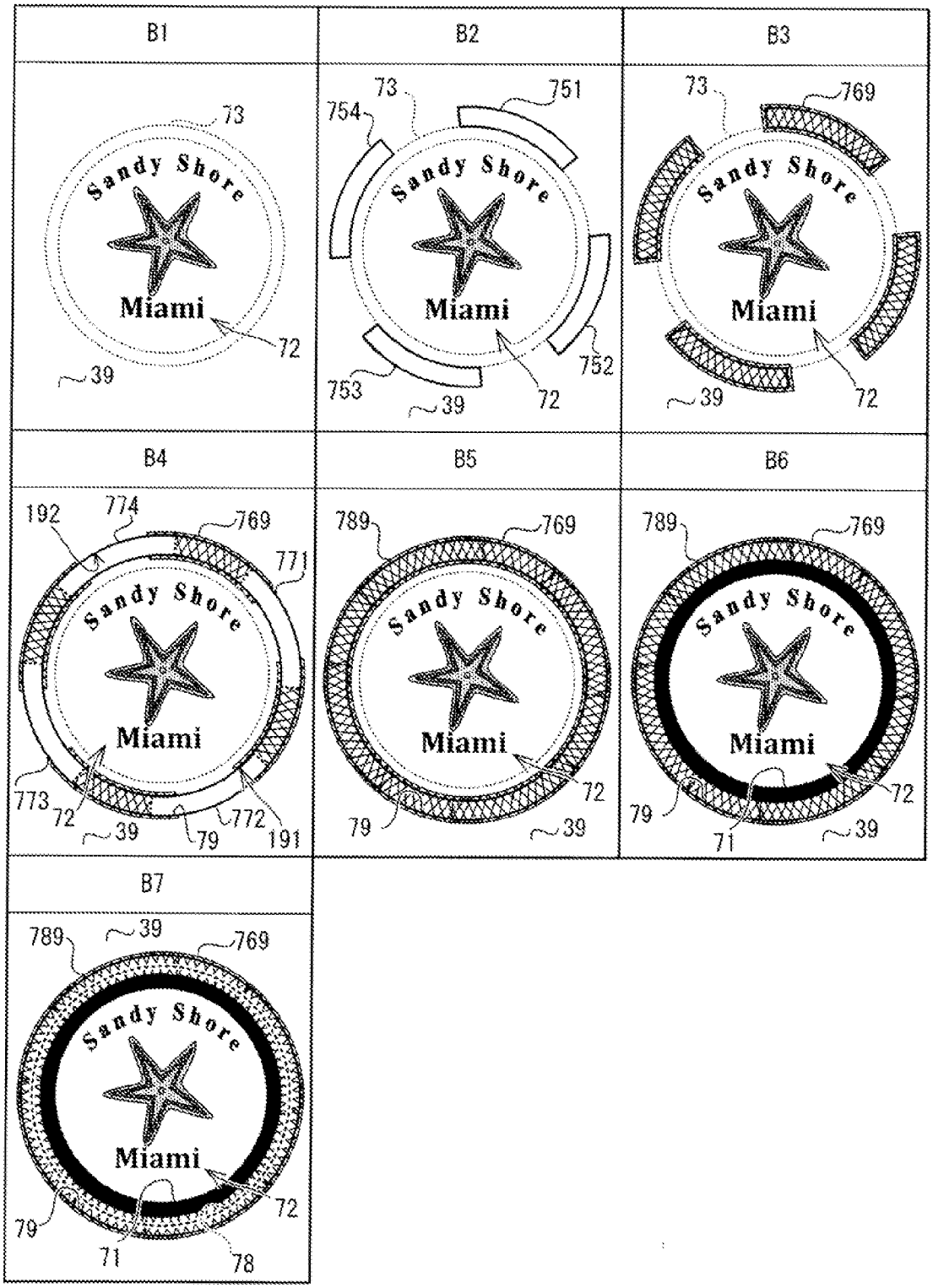
FIG. 12 is an explanatory figure of a process in which an object is formed in accordance with the sewing processing.

As shown in FIG. 9, the CPU 61 acquires the embroidery data that are stored in the RAM 63 (Step S31). The CPU 61 acquires the correspondence table 641 that is shown in FIG. 4, which is stored in the flash ROM 64 (Step S33). Based on the embroidery data that were acquired at Step S31 and on the correspondence table 641 that was acquired at Step S33, the CPU 61 determines which of the needle bars 31 will be used for forming the embroidery pattern 70, the stitches of the connecting stitching 770, and the partial holes 76, as well as which of the needle bars 31 will be used for cutting the stitches of the connecting stitching 770 (Step S35). As the needle bars 31 for forming the embroidery pattern 70, the CPU 61 sets the needle bars 31 that are associated with the colors that are indicated by the thread color data that are included in the embroidery data. For example, in a case where the color that is indicated by the thread color data is the first color, the CPU 61 sets the needle bar 31 with the needle bar number 5 as the needle bar 31 associated with the thread color data. In a case where the thread color for forming the stitches of the connecting stitching 770 is designated, the CPU 61 sets as the needle bar 31 for forming the stitches of the connecting stitching 770, the needle bar 31 that is associated with the designated color. In that case, the thread color for forming the stitches of the connecting stitching 770 may be designated by the user, and may also be designated in advance. In a case where the thread color for forming the stitches of the connecting stitching 770 is not designated, any of the needle bars 31 on which the sewing needles 51 have been mounted can be designated as the needle bar 31 for forming the stitches of the connecting stitching 770. In the present embodiment, the transparent thread is designated as the thread color for forming the stitches of the connecting stitching 770. The needle bar 31 with the needle bar number 10 is set as the needle bar 31 for forming the stitches of the connecting stitching 770.

The needle bars 31 for forming the partial holes 76 and for cutting the stitches of the connecting stitching 770 may be set as hereinafter described, for example, based on the needle drop points that are indicated by the embroidery data. From among the plurality of cutting needles 52, the CPU 61 sets the cutting needle 52 whose cutting edge direction is closest to the direction of a line segment that connects a needle drop point to an adjacent needle drop point.

The procedure for setting the needle bars 31 for forming the partial holes 76 and for cutting the stitches of the connecting stitching 770 will be explained using, as an example, a case in which the cutting needles 52 that will form the four first partial holes 75 are set. Based on the coordinates of the needle drop points that are indicated by the first partial hole data, the CPU 61 defines the line segments that connect the adjacent needle drop points. From among the angles that are formed between one of the defined line segments and a line segment that is parallel to the X axis and that intersects the defined line segment, the CPU 61 defines, as the angle of the defined line segment, the angle that goes counterclockwise from the line segment that is parallel to the X axis to the defined line segment. For example, a line segment 165 connects a needle drop point 161 and a needle drop point 162 that have been set for one of the first partial holes 75, as shown in FIG. 8. From among the angles that are formed between the line segment 165 and a line segment 171 that is parallel to the X axis and that intersects the line segment 165, the CPU 61 defines, as the angle of the line segment 165, an angle K1 that goes 160 degrees counterclockwise from the line segment 171 to the line segment 165. In the same manner, a line segment 166 connects a needle drop point 163 and a needle drop point 164. From among the angles that are formed between the line segment 166 and a line segment 172 that is parallel to the X axis and that intersects the line segment 166, the CPU 61 defines, as the angle of the line segment 166, an angle K2 that goes 40 degrees counterclockwise from the line segment 172 to the line segment 166.

Based on the angle of the defined line segment, the CPU 61 specifies, as a proximate cutting needle, the cutting needle 52 that has the cutting edge whose direction is the closest to the angle of the defined line segment. In the present embodiment, the directions of the cutting edges of the four cutting needles 52 are zero degrees, 45 degrees, 90 degrees, and 135 degrees, respectively. In the present embodiment, the direction of the cutting edge is represented by the angle, among the angles that are formed between the direction of the cutting edge and a line segment that is parallel to the X axis, that goes counterclockwise from the line segment that is parallel to the X axis to the direction of the cutting edge, in the same manner as the angle of the line segment. As shown in a table 180 in FIG. 10, in a case where the angle of the line segment is not less than zero degrees and is less than 22.5 degrees, and in a case where the angle of the line segment is not less than 157.5 degrees and is less than 180 degrees, the CPU 61 specifies, as the proximate cutting needle, the cutting needle 52 with the cutting edge direction of zero degrees. In the same manner, in a case where the angle of the line segment is not less than 22.5 degrees and is less than 67.5 degrees, the CPU 61 specifies, as the proximate cutting needle, the cutting needle 52 with the cutting edge direction of 45 degrees. In a case where the angle of the line segment is not less than 67.5 degrees and is less than 112.5 degrees, the CPU 61 specifies, as the proximate cutting needle, the cutting needle 52 with the cutting edge direction of 90 degrees. In a case where the angle of the line segment is not less than 112.5 degrees and is less than 157.5 degrees, the CPU 61 specifies, as the proximate cutting needle, the cutting needle 52 with the cutting edge direction of 135 degrees. The proximate cutting needle for the line segment 165 is the cutting needle 52 with the cutting edge direction of 135 degrees, and the proximate cutting needle for the line segment 166 is the cutting needle 52 with the cutting edge direction of 45 degrees. As shown in a table 190 in FIG. 11, the proximate cutting needles for all of the line segments are specified based on the needle drop points for the first partial holes 75.

The CPU 61 specifies the needle bar numbers that correspond to the directions of the cutting edges of the proximate cutting needles by referring to the correspondence table 641 in FIG. 4. For example, 1 is the needle bar number for the needle bar 31 on which is mounted the cutting needle 52 whose cutting edge direction is 45 degrees, and 3 is the needle bar number for the needle bar 31 on which is mounted the cutting needle 52 whose cutting edge direction is 135 degrees. The CPU 61 associates the needle bar number for the proximate cutting needle for each line segment with the needle drop points at both ends of the line segment. One of one and two of the needle bar numbers are allocated to each of the needle drop points. In a case where two of the needle bar numbers have been allocated to a needle drop point, each of the two cutting needles 52, which have different cutting edge directions, pierces the sewing workpiece 39 at that needle drop point. The needle bars 31 that will be used for forming the second partial holes 77 and cutting the stitches of the connecting stitching 770 are set in the same manner.

After the processing at Step S35 in FIG. 9, the CPU 61 drives the sewing needle drive portion 120 and the sewing target drive portion 130 in accordance with the embroidery data that were acquired at Step S31 to sew the interior pattern 72 (Step S37). As shown in part B1 of FIG. 12, the interior pattern 72 is formed on the sewing workpiece 39 by the processing at Step S37. The CPU 61 drives the sewing needle drive portion 120 and the sewing target drive portion 130 in accordance with the embroidery data that were acquired at Step S31 to form the first partial holes 75 (Step S39). In the processing at Step S39, cuts are formed at the needle drop points by using the cutting needles 52 that were set by the processing at Step S35, and the portions that are shown as the first partial holes 751 to 754 are cut out, as shown in part B2 of FIG. 12. The CPU 61 drives the sewing needle drive portion 120 and the sewing target drive portion 130 in accordance with the embroidery data that were acquired at Step S31 to form the stitches of the connecting stitching 769 for each of the four first partial holes 75 (Step S41). The stitches of the connecting stitching 769 are formed for the first partial holes 75 by the processing at Step S41, as shown in part 83 of FIG. 12, for example. The CPU 61 drives the sewing needle drive portion 120 and the sewing target drive portion 130 in accordance with the embroidery data that were acquired at Step S31 to form the second partial holes 77 (Step S43). In the processing at Step S43, cuts are formed at the needle drop points by using the cutting needles 52 that were set by the processing at Step S35, and the portions that are shown as the second partial holes 771 to 774 are cut out, as shown in part B4 of FIG. 12. The outer side hole 79 is formed as a whole by the first partial holes 75 and the second partial holes 77. The inner region 191 on the inner side of the outline 73 and the outer region 192 on the outer side of the outline 73 are connected by the stitches of the connecting stitching 769. Some of the stitches of the connecting stitching 769 are cut by the processing at Step S43.

The CPU 61 drives the sewing needle drive portion 120 and the sewing target drive portion 130 in accordance with the embroidery data that were acquired at Step S31 to form the stitches of the connecting stitching 789 for each of the four second partial holes 77 (Step S45). The stitches of the connecting stitching 789 are formed for the second partial holes 77 by the processing at Step S45, as shown in part B5 of FIG. 12, for example. The CPU 61 drives the sewing needle drive portion 120 and the sewing target drive portion 130 in accordance with the embroidery data that were acquired at Step S31 to sew the outline pattern 71 (Step S47). The outline pattern 71 is formed by the processing at Step S47, as shown in part B6 of FIG. 12. The inner side part of the stitches of the connecting stitching 770 on the inner side of the outline 73 is covered by the outline pattern 71. The CPU 61 drives the sewing needle drive portion 120 and the sewing target drive portion 130 in accordance with the embroidery data that were acquired at Step S31 to cut the stitches of the connecting stitching 770 (Step S49). In the processing at Step S49, the stitches of the connecting stitching 769 and the connecting stitching 789 are cut by using the cutting needles 52, as shown in part B7 of FIG. 12. The processing at Step S49 makes it possible for the user to separate the inner region 191 from the outer region 192. The user can produce the object that is formed by the embroidery pattern 70 by appropriately removing the cut ends of the stitches of the connecting stitching 770. The CPU 61 then terminates the sewing processing.

The effects hereinafter described can be achieved by the sewing machine 1 that is described above. In the embroidery data creation processing, the embroidery data are created such that the embroidery pattern 70 will be sewn by sewing the outline pattern 71 after forming the outer side hole 79 along the outline 73 of the embroidery pattern 70 by using the cutting needles 52. The outer side hole 79 is the hole that is formed by forming the first partial holes 75 and the second partial holes 77 in that order. If the outer side hole 79 is formed at one time, the inner region 191 is then removed from the sewing workpiece 39. Therefore, in any subsequent processing, it would be impossible for the sewing machine 1 to sew the embroidery pattern 70 in the inner region 191. In contrast to this, in the sewing machine 1, after the first partial holes 75 are formed, the stitches of the connecting stitching 769 are formed for the first partial holes 75 before the second partial holes 77 are formed. Therefore, in a case where the object is formed in accordance with the created embroidery data, the inner region 191 and the outer region 192 are connected by the stitches of the connecting stitching 769, even after the outer side hole 79 has been formed, so it is possible to sew the embroidery pattern 70 in the inner region 191 after the outer side hole 79 has been formed. Thus the sewing machine 1 is able to create embroidery data for forming an object such as a patch or the like that is cut out along the outline 73 of the embroidery pattern 70 without the use of a heat cutter.

Because the outline pattern 71 is formed after the outer side hole 79 is formed, the finished state of the outline 73 is more attractive than it would be in a case where the sewing workpiece 39 is cut along the outline 73 after the outline pattern 71 has been formed. Because the embroidery pattern 70 is not subjected to heat or exposed to water after it is sewn, as it would be with known technologies, the finished state of the object may not be impaired by these sorts of processing.

In a case where the object is made in accordance with the embroidery data that the sewing machine 1 has created, the stitches of the connecting stitching 770 are formed for all of the partial holes 76, so the inner region 191 and the outer region 192 are more reliably connected than they would be in a case where the stitches of the connecting stitching 769 are formed only for the first partial holes 75. The finished state of the embroidery may be improved by the fact that the inner region 191 is held from a plurality of directions by the stitches of the connecting stitching 770 that is formed for the partial holes 76. In a case where the object is made in accordance with the embroidery data that the sewing machine 1 has created, the adjacent partial holes 76 overlap one another, so it is possible to reliably prevent the sewing workpiece 39 from remaining uncut in locations where the partial holes 76 are planned to be formed. The sewing machine 1 forms the outer side hole 79 from the first partial holes 75 and the second partial holes 77 by arranging the first partial holes 75 and the second partial holes 77 alternately. Therefore, the time that is required in order to create the object is shortened by reducing to three the number of times that the processing switches between the processing that cuts the partial holes 76 and the processing that sews the connecting stitching 770.

By setting the length L1 for the partial holes 76 to a value that is not less than the value M1 and is less than the value M2, the sewing machine 1 is able both to use the connecting stitching 770 to hold the inner region 191 and to limit the processing time by making the number of the partial holes 76 as low as possible. In a case where the object is made in accordance with the embroidery data that the sewing machine 1 has created, the stitches of the connecting stitching 770 pulls the inner region 191 in the plurality of directions in which the stitches extend. Therefore, in a case where the object is made in accordance with the embroidery data that the sewing machine 1 has created, a more uniform tension can be maintained on the inner region 191 than in a case where the stitches of the connecting stitching 770 that spans any one of the partial holes 76 are all formed in a single direction or in a case where only one stitch constitutes the connecting stitching. Therefore, the embroidery data that are created make it possible to improve the finished state of the pattern that is formed after the outer side hole 79 is formed. In a case where the object is made in accordance with the embroidery data that the sewing machine 1 has created, the stitches of the connecting stitching 770 is cut by the sewing machine 1, so the user is spared the time and effort of cutting the stitches of the connecting stitching 770. In the sewing machine 1, either one of both the sewing needle 51 and the cutting needle 52 can be mounted on each of the plurality of needle bars 31. Therefore, unlike in a case where there is only one needle bar, it is not necessary to mount one of the cutting needles 52 on one of the needle bars 31 every time one of the partial holes 76 is formed. Therefore the user is spared the time and effort of replacing the cutting needle 52.

The sewing machine 1 automatically selects the cutting needles 52 that are suited to the shape of the partial holes 76, so the user is spared the time and effort of selecting the cutting needles 52. The sewing machine 1 sets the proximate cutting needles by taking into account the shape of the partial holes 76 and the directions of the cutting edges of the cutting needles 52. The direction of the cutting edge of the proximate cutting needle closely approximates the tangential direction of the shape of first partial hole 75 at each of the needle drop points. Therefore, in a case where the sewing machine 1 forms a cut by causing the specified cutting needle 52 to pierce the sewing workpiece 39, the cut that is formed in the sewing workpiece 39 has an attractive shape that follows the shape of the first partial hole 75. Because the CPU 61 specifies the cutting needle 52 based on the direction in which a line segment extends that connects two adjacent needle drop points, complicated processing to calculate the actual tangent line of the shape of the first partial hole 75 at the needle drop point is not required. The CPU 61 is therefore able to easily and accurately specify the cutting needle 52 that will pierce the sewing workpiece 39 at the needle drop point. In the present embodiment, the sewing machine 1 uses the transparent thread to form the stitches of the connecting stitching 770. The connecting stitching 770 therefore has little effect on the appearance of the object. In the present embodiment, the sewing machine 1 is provided with the function that creates the embroidery data, so the user can cause the sewing machine 1 to make the object immediately after the embroidery data are created.

The sewing machine according to the present disclosure is not limited to the embodiments described above, and various types of modifications may be made insofar as they are within the scope of the present disclosure. For example, the modifications (1) to (6) described below may be made as desired.

(1) The configuration of the sewing machine 1 may be modified as necessary. The present disclosure may also be applied to a home sewing machine and to an industrial sewing machine. The number of needle bars may be changed as desired. As the cutting needle that can be mounted in the sewing machine, a cutting needle with a cutting edge that is configured to form a cut in a sewing workpiece is applicable. The apparatus that creates the embroidery data may also be an external apparatus that is separate from the sewing machine 1. More specifically, the apparatus that creates the embroidery data may also be a known personal computer (PC), for example. In a case where the embroidery data are created by an external apparatus that is separate from the sewing machine 1, the embroidery data may be stored in a storage device such as a memory card or the like and be read by the sewing machine 1. The sewing machine 1 may also form an object such as a patch or the like by operating the sewing needle drive portion 120 and the sewing target drive portion 130 based on the acquired embroidery data. In a case where the sewing processing is performed by a sewing machine that has only one needle bar, the processing at Steps S33 and S35 in FIG. 9 may be omitted. In that case it is preferable that the user be notified when a thread replacement is required, as well as when it is necessary to replace a cutting needle with a sewing needle and vice-versa.

(2) As the embroidery pattern that makes up an object, a pattern in which an outline can be specified is applicable. For example, an embroidery pattern that makes up an object may be a pattern such as a pattern 270 that is shown in part C1 of FIG. 13. The pattern 270 is a pattern that is only an outline pattern, and it is a pattern in which satin stitches are formed in an inner region 291 that is on the inner side of the outline. In a case where the embroidery data creation processing in FIG. 6 is performed for the pattern 270, in the processing at Step S5, the CPU 61 specifies an outline 273 that is shown in part C2 of FIG. 13, and in the processing at Step S7, the CPU 61 sets an outer circumference 274 of outer side hole 279, the outer circumference 274 being located outside of the outline 273 by a length L14. The outer side hole 279 is a hole that separates the inner region 291, which is the region on the inner side of the outline 273, from an outer region 292, which is a region on the outer side of the outline 273. In the processing at Step S13, the CPU 61 may create the first partial hole data for forming first partial holes 275 that are shown in part C2 of FIG. 13, and in the processing at Step S19, the CPU 61 may create the second partial hole data for forming second partial holes 277 that are shown in part C3 of FIG. 13. In this case, it is acceptable for the lengths of the first partial holes 275 and the lengths of the second partial holes 277 not to be fixed lengths.

Figure 13:
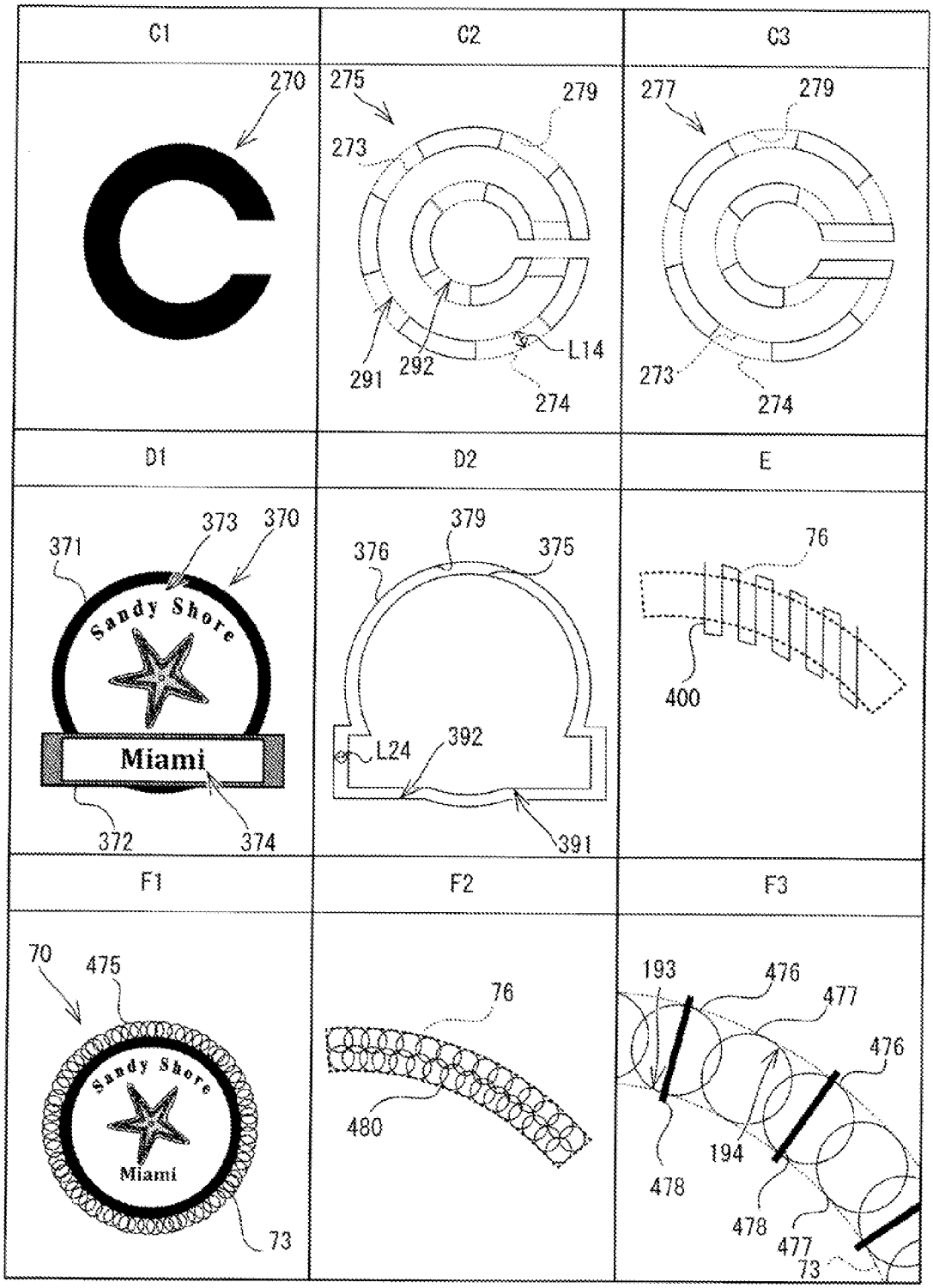
FIG. 13 is an explanatory figure of a modified example.

In a different specific example, an embroidery pattern that makes up an object may be a pattern like a pattern 370 that is shown as an example in part D1 of FIG. 13. The pattern 370 includes outline patterns 371, 372 and interior patterns 373, 374. An outline 375 of the pattern 370 is specified by the stitches in the plurality of outline patterns 371, 372. In a case where the embroidery data creation processing in FIG. 6 is performed for the pattern 370, in the processing at Step S5, the CPU 61 specifies the outline 375, which is shown in part D2 of FIG. 13, based on the plurality of outline patterns 371, 372. In the processing at Step S7, the CPU 61 sets an outer circumference 376 of outer side hole 379, the outer circumference 376 being located outside of the outline 375 by a length L24. The outer side hole 379 is a hole that separates an inner region 391, which is the region on the inner side of the outline 375, from an outer region 392, which is a region on the outer side of the outline 375. In the processing at Step S25, the CPU 61 creates, as the embroidery data, data that cause each of the plurality of outline patterns 371, 372 to be formed after the outer side hole 379 is formed.

(3) The shape, the number, the arrangement, and the like of the partial holes for forming the outer side hole may be modified as desired. For example, the first length for the first partial holes and the first length for the second partial holes may be different from one another. The shapes of the first partial holes and the second partial holes may also be the shapes of the cutting edges of the cutting needles. That is, one partial hole may be formed by piercing the sewing workpiece one time with the cutting needle. More specifically, in a case where the hole that the cutting needle cuts in the sewing workpiece is circular, a plurality of circular first partial holes 475 may be formed around the circumference of the outline 73, as shown in part F1 of FIG. 13. The sewing machine 1 may also form the partial holes 76 in the embodiment that is described above by piercing the sewing workpiece a plurality of times with a cutting needle that forms a hole 480 of a specified shape (for example, a circle), as shown in part F2 of FIG. 13. In these cases, the sewing machine 1 is able to form each of a plurality of partial holes without taking into account the directions of the cutting edges.

(4) The configuration of the connecting stitching may be modified as desired. From the standpoint of the inner region being held by being pulled uniformly in a plurality of directions by the connecting stitching, it is preferable for the connecting stitching that spans any one partial hole to include a plurality of stitches that extend in directions that intersect one another. Rather than stitches 400, as shown in part E of FIG. 13, in which all of the stitches that span the partial hole 76 extend in the same direction, it is preferable for the stitches to extend in a plurality of directions, such as radial directions, for example. Rather than the stitches 400, as shown in part E of FIG. 13, which are formed for a portion of the partial hole 76, it is preferable for the stitches to be formed uniformly for the entire partial hole 76. However, stitches such as some of the stitches of the connecting stitching 769 for the first partial holes 75 in the embodiment that is described above, which are cut when the other partial holes 76 are formed, do not necessarily have to be formed uniformly. The connecting stitching for the second partial holes may be omitted as necessary. For example, the CPU 61 may form one circular partial hole by causing the cutting needle to pierce the sewing workpiece one time, as shown in part F1 of FIG. 13. In that case, connecting stitching 478 that includes one stitch may be formed only for each of first partial holes 476, and not be formed for second partial holes 477, as shown in part F3 of FIG. 13. Even in this sort of case, an inner region 193 is connected to an outer region 194 by the connecting stitching 478 and held in that state.

(5) The pattern data and the programs that contain the instructions for performing the embroidery data creation processing in FIG. 6 and the sewing processing in FIG. 9 may be stored in a storage device of the sewing machine 1 before the sewing machine 1 (the device that creates the embroidery data) executes the programs. Therefore, the methods by which the programs and the pattern data are acquired, the routes by which they are acquired, and the device in which the programs are stored may each be modify as desired. The pattern data and the programs, which are executed by the processor of the sewing machine 1, may be received from another device through one of a cable and wireless communications, and they may be stored in a storage device such as a flash memory or the like. The other device may be, for example, a PC or a server that is connected through a network.

(6) The individual steps in the embroidery data creation processing in FIG. 6 and the sewing processing in FIG. 9 are not limited to the example of being performed by the CPU 61, and some or all of the steps may also be performed by another electronic device (for example, an ASIC). The individual steps of the processing described above may also be performed by distributed processing among a plurality of electronic devices (for example, a plurality of CPUs). The order of the individual steps in the embroidery data creation processing and the sewing processing can be modified as necessary, and steps can be omitted and added. Furthermore, a case in which an operating system (OS) or the like that is operating in the sewing machine 1 performs some or all of the actual processing, based on commands from the CPU 61 of the sewing machine 1, and the functions of the embodiment that is described above are implemented by that processing, falls within the scope of the present disclosure. The modifications hereinafter described in paragraphs (6-1) to (6-6) may also be applied to the embroidery data creation processing in FIG. 6 and the sewing processing in FIG. 9 as desired.

(6-1) In the processing at Step S13, the CPU 61 may create both the first partial hole data and the second partial hole data. In the same manner, the CPU 61 may create both the first stitch data and the second stitch data in the processing at Step S17. In the processing at Steps S11 and S15, the CPU 61, by adjusting at least one of the first length L1 of the partial holes and the second length L2, may arrange the first partial holes and the second partial holes alternately, and may set the first length of the partial holes to a value within a specified range.

(6-2) In a case where the connecting stitching is not sewn for the second partial holes, the processing at Step S21 may be omitted. In that case, in the processing at Step S25, the CPU 61 may create, as the embroidery data, data for forming the interior pattern 72, the first partial holes 75, the stitches of the connecting stitching for the first partial holes 75, the second partial holes 77, and the outline pattern 71 in that order, and then cutting the stitches of the connecting stitching last, for example.

(6-3) The processing at Step S23 may also be omitted as necessary. In that case, in the processing at Step S25, the CPU 61 creates the embroidery data based on the pattern data, the first partial hole data, the first stitch data, the second partial hole data, and the second stitch data that were one of acquired and created by the processing that preceded Step S25, and then stores the created embroidery data in the RAM 63. The CPU 61 may also create, as the embroidery data, data for forming the interior pattern 72, the first partial holes 75, the stitches of the connecting stitching for the first partial holes 75, the second partial holes 77, the stitches of the connecting stitching for the second partial holes 77, and the outline pattern 71 in that order, for example. The user may cut the stitches of the connecting stitching appropriately using scissors or the like.

(6-4) The point in the sewing order at which the interior pattern 72 that is represented by the embroidery data that are created by the processing at Step S25 is formed may be modified as desired. For example, in a case where the cut data are created by the embroidery data creation processing, the point in the sewing order at which the interior pattern 72 that is represented by the embroidery data is formed need only be prior to the cutting of the stitches of the connecting stitching. In a case where the cut data are not created by the embroidery data creation processing, for example, the interior pattern 72 that is represented by the embroidery data may be formed at any point in the sewing order.

(6-5) In a case where a plurality of first partial holes 75 are formed, as in the embodiment that is described above, the stitches of the connecting stitching is formed for the individual first partial holes 75 after the plurality of first partial holes 75 have been formed, in consideration of the sewing time. However, in a case where a plurality of first partial holes 75 are formed, it is also acceptable to repeatedly alternate between forming at least one of the plurality of first partial holes 75 and forming the stitches of the connecting stitching for as many of the first partial holes 75 as have been formed. In the same manner, in a case where a plurality of second partial holes 77 are formed, it is acceptable to repeatedly alternate between forming at least one of the plurality of second partial holes 77 and forming the stitches of the connecting stitching for as many of the second partial holes 77 as have been formed. In other words, it is acceptable for the stitches of the connecting stitching for the outer side hole to be formed before completion of forming of the outer side hole.

(6-6) The number of the cutting needles that are used for forming the partial holes and the method by which they are specified may be modified as desired. For example, in a case a specific cutting needle is used consecutively, but the number of times the cutting needle is consecutively used less than a specified number, the specific needle may be replaced by another cutting needle that is used before or after the specific cutting needle, in consideration of the processing time. This makes it possible for the sewing machine 1 to shorten the time that is spent switching the cutting needles. In a multi-needle sewing machine in which a plurality of cutting needles can be mounted, the partial holes may be formed by only some of the plurality of cutting needles, in consideration of the processing time. Specifically, in the processing at Step S35 in FIG. 9, two of the four cutting needles may be selected to be used for forming the partial holes, and either one of the two selected cutting needles may be assigned as the cutting needle to be used for any given line segment. After specifying the proximate cutting needles, the CPU 61 selects two of the cutting needles 52 from among the four cutting needles 52, selecting the two cutting needles 52 in descending order of the number of times that the cutting needles 52 have been specified as the proximate cutting needles, based on the needle drop points for the four first partial holes 75. For example, for the four first partial holes 75, the cutting needle 52 whose cutting edge direction is 135 degrees and the cutting needle 52 whose cutting edge direction is 45 degrees are selected as the two cutting needles 52. In a case where every one of the four cutting needles 52 has been specified as the proximate cutting needle the same number of times, any two of the cutting needles 52 whose cutting edge directions differ by 90 degrees may be selected, for example. The CPU 61 assigns either one of the cutting needle 52 whose cutting edge direction is 135 degrees and the cutting needle 52 whose cutting edge direction is 45 degrees as the cutting needle to be used for each of the needle drop points for the four first partial holes 75. In the same manner as previously described, the CPU 61 specifies one of the cutting needle 52 whose cutting edge direction is 135 degrees and the cutting needle 52 whose cutting edge direction is 45 degrees as the cutting needle to be used for the defined line segment, based on the angle of the defined line segment. In a case where the angle of the line segment is not less than zero degrees and is less than 90 degrees, the CPU 61 specifies the cutting needle 52 whose cutting edge direction is 45 degrees as the cutting needle to be used. In the same manner, in a case where the angle of the line segment is not less than 90 degrees and is less than 180 degrees, the CPU 61 specifies the cutting needle 52 whose cutting edge direction is 135 degrees as the cutting needle to be used. As shown in the table 190, the cutting needles to be used are specified for all of the line segments, based on the needle drop points for the first partial holes 75. Instead of assigning the proximate cutting needles according to the embodiment that is described above, the CPU 61 may assign the cutting needle to be used for a line segment to the needle drop points at both ends of the line segment. This makes it possible to make the time that is required in order to switch the cutting needles 52 shorter than it would be in a case where four of the cutting needles 52 are used. Accordingly, the sewing machine 1 is able to form the cuts in the sewing workpiece 39 along the lines that indicate the shape of the pattern that the user desires in a shorter time.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus, comprising:

a processor; and a memory configured to store computer-readable instructions that, when executed by the processor, instruct the processor to perform processes comprising:

acquiring pattern data representing a plurality of stitches for sewing, by a sewing machine, an embroidery pattern that includes an outline pattern, specifying an outline of the embroidery pattern based on the pattern data, creating, based on the specified outline, hole data for causing the sewing machine to form a plurality of holes along the specified outline, the hole data representing positions of needle drop points for forming the plurality of holes including one or more first holes and one or more second holes, creating, based on the hole data, first stitch data for causing the sewing machine to sew one or more stitches for the one or more first holes, the first data representing positions of needle drop points for sewing the one or more stitches that connect two regions separated by the plurality of holes, by spanning one of the plurality of holes, creating, based on the pattern data, the hole data, and the first stitch data, embroidery data for causing the sewing machine to form the one or more first holes, sew the one or more stitches for the one or more first holes, and causing the sewing machine to form the one or more second holes, before causing the sewing machine to sew the outline pattern.

2. The apparatus according to claim 1, wherein the computer-readable instructions further instruct the processor to perform the process of:

creating second stitch data for causing the sewing machine to sew the one or more stitches for the one or more second holes, wherein the creating of the embroidery data includes creating, based on the pattern data, the hole data, the first stitch data, and the second stitch data, the embroidery data for causing the sewing machine to sew the outline pattern after causing the sewing machine to sew the one or more stitches for the one or more second holes.

3. The apparatus according to claim 1, wherein the creating of the hole data includes creating the hole data by adjusting at least one of a first length and a second length, arranging the one or more first holes and the one or more second holes alternately, and setting the first length to a value within a specified range, the first length being a length of a portion that follows the outline, within each of the plurality of holes, and the second length being a length of a portion that follows the outline where one of the one or more first holes overlaps one of the one or more second holes.

4. The apparatus according to claim 1, wherein the one or more stitches includes a plurality of stitches that extend in directions that intersect one another.

5. The apparatus according to claim 1, wherein the computer-readable instructions further instruct the processor to perform the process of:

creating cut data for causing the sewing machine to cut the one or more stitches, wherein the creating of the embroidery data includes creating, based on the pattern data, the hole data, the first stitch data, and the cut data, the embroidery data for causing the sewing machine to cut the one or more stitches after causing the sewing machine to sew the embroidery pattern.

6. The apparatus according to claim 2, wherein the computer-readable instructions further instruct the processor to perform the process of:

creating cut data for causing the sewing machine to cut the one or more stitches, wherein the creating of the embroidery data includes creating, based on the pattern data, the hole data, the first stitch data, and the cut data, the embroidery data for causing the sewing machine to cut the one or more stitches after causing the sewing machine to sew the embroidery pattern.

7. The apparatus according to claim 1, wherein the embroidery pattern further includes a sub-pattern, and the creating of the embroidery data includes creating, based on the pattern data, the hole data, and the first stitch data, the embroidery data for causing the sewing machine to form the one or more first holes after causing the sewing machine to sew the sub-pattern.

8. A sewing machine, comprising:

one or more needle bars, each of the one or more needle bars being configured to be mounted with one of a cutting needle and a sewing needle;

a sewing device configured to move one of the one or more needle bars up and down;

a processor; and a memory configured to store computer-readable instructions that, when executed by the processor, instruct the processor to perform processes comprising:

acquiring pattern data representing a plurality of stitches for sewing, by a sewing device, an embroidery pattern that includes an outline pattern, specifying an outline of the embroidery pattern based on the pattern data, creating, based on the specified outline, hole data for causing the sewing device to form a plurality of holes along the specified outline, the hole data representing positions of needle drop points for forming the plurality of holes including one or more first holes and one or more second holes, creating, based on the hole data, first stitch data for causing the sewing device to sew one or more stitches for the one or more first holes, the first data representing positions of needle drop points for sewing the one or more stitches that connect two regions separated by the plurality of holes, by spanning one of the plurality of holes, creating, based on the pattern data, the hole data, and the first stitch data, embroidery data for causing the sewing device to form the one or more first holes, sew the one or more stitches for the one or more first holes, and causing the sewing device to form the one or more second holes, before causing the sewing device to sew the outline pattern, and causing, in accordance with the embroidery data, the sewing device to, form the plurality of holes by using the cutting needle, sew the connecting stitching, and sew the outline pattern.

9. The sewing machine according to claim 8, wherein the computer-readable instructions further instruct the processor to perform the process of:

creating second stitch data for causing the sewing device to sew the one or more stitches for the one or more second holes, wherein the creating of the embroidery data includes creating, based on the pattern data, the hole data, the first stitch data, and the second stitch data, the embroidery data for causing the sewing device to sew the outline pattern after causing the sewing device to sew the one or more stitches for the one or more second holes.

10. The sewing machine according to claim 8, wherein the computer-readable instructions further instruct the processor to perform the process of:

creating cut data for causing the sewing device to cut the one or more stitches, wherein the creating of the embroidery data includes creating, based on the pattern data, the hole data, the first stitch data, and the cut data, the embroidery data for causing the sewing device to cut the one or more stitches after causing the sewing device to sew the embroidery pattern, and causing, in accordance with the embroidery data, the sewing device to cut the connecting stitching by using the cutting needle.

11. The sewing machine according to claim 9, wherein the computer-readable instructions further instruct the processor to perform the process of:

creating cut data for causing the sewing device to cut the connecting stitching, wherein the creating of the embroidery data includes creating, based on the pattern data, the hole data, the first stitch data, and the cut data, the embroidery data for causing the sewing device to cut the one or more stitches after causing the sewing device to sew the embroidery pattern, and causing, in accordance with the embroidery data, the sewing device to cut the connecting stitching by using the cutting needle.

12. The sewing machine according to claim 8, wherein the embroidery pattern further includes a sub-pattern, and the creating of the embroidery data includes creating, based on the pattern data, the hole data, and the first stitch data, the embroidery data for causing the sewing device to form the one or more first holes after causing the sewing device to sew the sub-pattern.

13. The sewing machine according to claim 8, wherein the sewing machine is a multi-needle sewing machine that comprises a plurality of needle bars, the plurality of needle bars are configured to be mounted with a plurality of cutting needles in positions in which cutting edges of the plurality of cutting needles are oriented in different directions, the computer-readable instructions further instruct the processor to perform the following processes:

acquiring correspondences between the plurality of needle bars and the directions of the cutting edges of the plurality of cutting needles that are respectively mounted on the plurality of needle bars, and setting, from among the plurality of cutting needles, a cutting needle that will cut each of the plurality of holes, based on the correspondences and on a shape of each of the plurality of holes, wherein the causing of the sewing device to form the plurality of holes includes causing the sewing device to form each of the plurality of holes by using the cutting needle that has been set.

14. A non-transitory computer-readable medium storing computer-readable instructions that, when executed, instruct a processor of an apparatus to perform processes comprising:

acquiring pattern data representing a plurality of stitches for sewing, by a sewing machine, an embroidery pattern that includes an outline pattern, specifying an outline of the embroidery pattern based on the pattern data, creating, based on the specified outline, hole data for causing the sewing machine to form a plurality of holes along the specified outline, the hole data representing positions of needle drop points for forming the plurality of holes including one or more first holes and one or more second holes, creating, based on the hole data, first stitch data for causing the sewing machine to sew one or more stitches for the one or more first holes, the first data representing positions of needle drop points for sewing the one or more stitches that connect two regions separated by the plurality of holes, by spanning one of the plurality of holes, creating, based on the pattern data, the hole data, and the first stitch data, embroidery data for causing the sewing machine to form the one or more first holes, sew the one or more stitches for the one or more first holes, and causing the sewing machine to form the one or more second holes, before causing the sewing machine to sew the outline pattern.

15. The non-transitory computer-readable medium according to claim 14, wherein the computer-readable instructions further instruct the processor to perform the process of:

creating second stitch data for causing the sewing machine to sew the one or more stitches for the one or more second holes, wherein the creating of the embroidery data includes creating, based on the pattern data, the hole data, the first stitch data, and the second stitch data, the embroidery data for causing the sewing machine to sew the outline pattern after causing the sewing machine to sew the one or more stitches for the one or more second holes.

16. The non-transitory computer-readable medium according to claim 14, wherein the creating of the hole data includes creating the hole data by adjusting at least one of a first length and a second length, arranging the one or more first holes and the one or more second holes alternately, and setting the first length to a value within a specified range, the first length being a length of a portion that follows the outline, within each of the plurality of holes, and the second length being a length of a portion that follows the outline where one of the one or more first holes overlaps one of the one or more second holes.

17. The non-transitory computer-readable medium according to claim 14, wherein the one or more stitches includes a plurality of stitches that extend in directions that intersect one another.

18. The non-transitory computer-readable medium according to claim 14, wherein the computer-readable instructions further instruct the processor to perform the process of:

creating cut data for causing the sewing machine to cut the one or more stitches, wherein the creating of the embroidery data includes creating, based on the pattern data, the hole data, the first stitch data, and the cut data, the embroidery data for causing the sewing machine to cut the one or more stitches after causing the sewing machine to sew the embroidery pattern.

19. The non-transitory computer-readable medium according to claim 15, wherein the computer-readable instructions further instruct the processor to perform the process of:

creating cut data for causing the sewing machine to cut the one or more stitches, wherein the creating of the embroidery data includes creating, based on the pattern data, the hole data, the first stitch data, and the cut data, the embroidery data for causing the sewing machine to cut the one or more stitches after causing the sewing machine to sew the embroidery pattern.

20. The non-transitory computer-readable medium according to claim 14, wherein the embroidery pattern further includes a sub-pattern, and the creating of the embroidery data includes creating, based on the pattern data, the hole data, and the first stitch data, the embroidery data for causing the sewing machine to form the one or more first holes after causing the sewing machine to sew the sub-pattern.

* * * * *